US009403354B2

(12) United States Patent
Wursch et al.

(10) Patent No.: US 9,403,354 B2
(45) **Date of Patent: *Aug. 2, 2016**

(54) NUMBERING DEVICE FOR TYPOGRAPHIC NUMBERING

(71) Applicant: KBA-NOTASYS SA, Lausanne (CH)

(72) Inventors: Alain Wursch, La Tour-de-Peilz (CH); Antoine Merminod, Gimel (CH)

(73) Assignee: KBA-NotaSys SA, Lausanne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/185,555

(22) Filed: Feb. 20, 2014

(65) Prior Publication Data

US 2014/0165862 A1 Jun. 19, 2014

Related U.S. Application Data

(62) Division of application No. 12/305,522, filed as application No. PCT/IB2007/052366 on Jun. 20, 2007, now Pat. No. 8,671,836.

(30) Foreign Application Priority Data

Jun. 23, 2006 (EP) ..... 06115994
Nov. 20, 2006 (EP) ..... 06124403

(51) Int. Cl.
*B41L 45/00* (2006.01)
*B41K 3/12* (2006.01)
(Continued)

(52) U.S. Cl.
CPC ..... *B41F 13/0032* (2013.01); *B41F 33/009* (2013.01); *B41K 1/16* (2013.01); *B41K 3/105* (2013.01); *B41K 3/127* (2013.01)

(58) Field of Classification Search
CPC ..... B41K 1/16; B41K 3/08; B41K 3/10; B41K 3/102; B41K 3/105; B41K 3/126; B41K 3/127; B41K 3/266; B41F 13/0032
See application file for complete search history.

(56) References Cited

U.S. PATENT DOCUMENTS 1,691,889 A 11/1928 Meisel
3,385,213 A 5/1968 Stephan
(Continued)

FOREIGN PATENT DOCUMENTS

DE 500 525 6/1930
DE 605 847 11/1934
(Continued)

OTHER PUBLICATIONS

International Search Report for PCT/IB2007/052366, mailed Dec. 11, 2007.
(Continued)

*Primary Examiner* — Justin Olamit
(74) *Attorney, Agent, or Firm* — Nixon & Vanderhye P.C.

(57) ABSTRACT

There is described a numbering device (1) for carrying out numbering in sheet-fed or web-fed numbering presses, the numbering device (1) comprising a numbering unit (6) with rotatable numbering wheels (7) carrying alpha-numerical symbols thereon, which numbering wheels (7) are disposed next to each other and rotate about a common rotation axis (17), the numbering device (1) further comprising electro-mechanical actuation means for setting the position of the numbering wheels (7). The electro-mechanical actuation means are entirely located within the numbering device (1) and are mechanically autonomous, the electro-mechanical actuation means comprising a plurality of independent driving means (15, 18-23; 23*) for actuating a corresponding plurality of the numbering wheels.

27 Claims, 22 Drawing Sheets

(51) Int. Cl.

| | |
|---|---|
| ***B41J 1/60*** | (2006.01) |
| ***B41F 13/00*** | (2006.01) |
| ***B41K 1/16*** | (2006.01) |
| ***B41F 33/00*** | (2006.01) |
| ***B41K 3/10*** | (2006.01) |

(56) References Cited

U.S. PATENT DOCUMENTS

| | | | | |
|---|---|---|---|---|
| 3,429,258 | A | 2/1969 | Baranoff et al. | |
| 3,484,666 | A * | 12/1969 | Easton | 318/640 |
| 3,728,960 | A | 4/1973 | Heath | |
| 3,734,010 | A | 5/1973 | Le Gault et al. | |
| 3,938,436 | A | 2/1976 | Woodhouse | |
| 3,939,621 | A | 2/1976 | Giori | |
| 4,013,005 | A | 3/1977 | Keefe | |
| 4,045,944 | A | 9/1977 | Giori | |
| 4,207,814 | A | 6/1980 | Schenk | |
| 4,343,238 | A | 8/1982 | Koch et al. | |
| 4,391,496 | A | 7/1983 | Schilling et al. | |
| 4,453,707 | A | 6/1984 | Kuhfuss | |
| 4,485,735 | A | 12/1984 | Jonca | |
| 4,558,557 | A | 12/1985 | Kuehfuss | |
| 4,677,910 | A | 7/1987 | Kuhfuss | |
| 4,776,224 | A * | 10/1988 | Maezawa et al. | 74/7 E |
| 4,843,959 | A | 7/1989 | Rendell | |
| 4,889,051 | A | 12/1989 | Sarda | |
| 4,928,089 | A | 5/1990 | Gasiunas et al. | |
| 5,517,911 | A | 5/1996 | Rendell et al. | |
| 5,626,005 | A | 5/1997 | Klingelhoefer | |
| 5,660,106 | A | 8/1997 | Pitz et al. | |
| 6,325,331 | B1 * | 12/2001 | McKeown | 244/76 A |
| 6,644,876 | B2 | 11/2003 | Carriere et al. | |
| 6,707,200 | B2 | 3/2004 | Carroll et al. | |
| 6,876,109 | B2 | 4/2005 | Matsushita et al. | |
| 8,671,836 | B2 * | 3/2014 | Wursch et al. | 101/77 |
| 2003/0131702 | A1 | 7/2003 | Sauer et al. | |
| 2006/0162585 | A1 | 7/2006 | Schaede | |
| 2007/0012134 | A1 | 1/2007 | Daout | |
| 2008/0028965 | A1 | 2/2008 | Herbert et al. | |
| 2009/0224029 | A1 | 9/2009 | Schade et al. | |

FOREIGN PATENT DOCUMENTS

| | | | |
|---|---|---|---|
| DE | 14 86 894 | | 7/1969 |
| DE | 26 29 442 | A1 | 1/1978 |
| DE | 30 47 390 | A1 | 7/1982 |
| DE | 36 07 768 | A1 | 10/1986 |
| DE | 36 18 488 | | 7/1987 |
| DE | 44 46 273 | A1 | 6/1996 |
| EP | 0 032 555 | A1 | 7/1981 |
| EP | 0 167 196 | | 1/1986 |
| EP | 0 286 317 | | 10/1988 |
| EP | 0 305 235 | A1 | 3/1989 |
| EP | 481185 | A1 | 4/1992 |
| EP | 0 598 679 | A1 | 5/1994 |
| EP | 0 619 187 | A1 | 10/1994 |
| EP | 0 656 309 | A1 | 6/1995 |
| EP | 1 389 524 | | 2/2004 |
| EP | 1 496 598 | A2 | 1/2005 |
| EP | 1 607355 | A1 | 12/2005 |
| EP | 1 731 324 | A1 | 12/2006 |
| EP | 2 230 087 | A1 | 9/2010 |
| EP | 2 236 295 | A1 | 10/2010 |
| EP | 2 243 629 | A1 | 10/2010 |
| GB | 2 016 377 | A | 9/1979 |
| GB | 2 174 957 | A | 11/1986 |
| GB | 2 262 729 | | 6/1993 |
| IN | 180984 | | 4/1994 |
| JP | UM 06-68849 | A | 9/1994 |
| JP | 10-175360 | A | 6/1998 |
| JP | 2004160788 | A | 6/2004 |
| WO | WO 92/03294 | A1 | 3/1992 |
| WO | WO 01/49464 | A1 | 7/2001 |
| WO | 2004/016433 | | 2/2004 |
| WO | 2005/018945 | | 3/2005 |

OTHER PUBLICATIONS

Written Opinion of the International Searching Authority for PCT/IB2007/052366, mailed Dec. 11, 2007.

European Search Report for applicant's divisional European Patent Application 12160752.7.

European Search Report for applicant's divisional European Patent Application 12185299.0.

A document in German language (no English translation available) entitled "Bürstenloser Gleischstrommotor mit Blockkommutierung" apparently dated Sep. 25, 2000.

Extracts from the 2006-2007 product catalogue of Maxon Motor AG (http://www.maxonmotor.com) in German language.

Extracts from the 2004-2005 product catalogue of Maxon Motor AG (http://www.maxonmotor.com) in German language.

Extracts from a book in German language (no English translation available) entitled "Getriebemotoren", Franz Josef Mack, third edition, 2001 (ISBN 3-478-93247-5.

Extracts from a book in German language (no English translation available) entitled "Mechatronische Antriebssysteme", Peter F. Brosch, 2000 (ISBN 3-478-93220-3).

Extracts from a book in German language (no English translation available) entitled "Elektrische Stellantriebe kleiner Leistung", Christian Richter, 1988 (ISBN 3-8007-1514-7).

Extracts from a book in German language (no English translation available) entitled "Handbuch Elektrische Kleinantriebe", Hans-Dieter Stötling et al., second edition, 2002 (ISBN 3-446-21985-4).

Alleged public prior uses relate to: a so-called "PC-LEN6" numbering device.

Alleged public prior uses relate to: a so-called "PC-LEN7" numbering device.

Alleged public prior uses relate to: a so-called "Loewe-Werk" numbering device.

* cited by examiner

NUMBERING DEVICE FOR TYPOGRAPHIC NUMBERING

This application is a divisional of application Ser. No. 12/305,522, filed Dec. 18, 2008, which is the U.S. national phase of International Application No. PCT/IB2007/052366, filed Jun. 20, 2007, which designated the U.S. and claims priority to European Application No(s). 06115994.3, filed Jun. 23, 2006 and Ser. No. 06/124,403.4, filed 20 Nov. 2006, the entire contents of each of which are hereby incorporated by reference.

TECHNICAL FIELD

The present invention generally relates to a numbering device (also referred to as "numbering box") for carrying out typographic numbering in sheet-fed or web-fed numbering presses, especially for the numbering of sheets of securities, such as banknotes, passports, ID, checks and other similar objects.

BACKGROUND OF THE INVENTION

In the art of printing machines for securities, such as banknotes, checks and other similar objects, an important feature which is printed on said securities is a serial number. For example, each printed banknote typically receives a unique combination of numbers and characters building the serial number of the banknote.

Many numbering processes have been developed in the art. For example, U.S. Pat. No. 4,677,910, the content of which is incorporated by reference in the present application, discloses a process and an apparatus for processing security prints arranged in lines and columns on a carrier in the form of webs or sheets. In this particular example, the printed carriers pass, in succession, by a reading instrument which detects the positions of defective prints identified by a mark and feeds the position to a computer for storage, a cancellation printer controlled by the computer which provides the defective prints with a cancellation print, and a numbering machine. The numbering mechanisms of this numbering machine are actuated by the computer in such a way that always the satisfactory prints, placed in succession in any longitudinal row, are serially numbered, defective prints being neglected. Subsequently, the printed carriers, having passed by another reading instrument, are cut into individual securities, each carrying one print, the defective securities are separated out in a separation device and the remaining, serially numbered individual securities are assembled to form bundles, each having a complete numerical sequence. In this way, a correct and complete numerical sequence of the securities in the bundles is ensured, in spite of the separation of defective securities.

The above approach is however not very adequate from the point of view of production efficiency as the numbering and collecting principle as well as the separation of the defective securities is very time consuming. Another more convenient way to proceed is to number sheets carrying only good prints, sheets having defective prints following a separate route. Entirely defective sheets, i.e. sheets having no good print whatsoever, are destroyed. Partially good sheets can also be destroyed or, more conveniently, be cut into individual securities and processed separately on a single-note numbering machine where only the good securities are numbered in sequence. This approach is preferable from the point of view of optimising the production while still ensuring uninterrupted numerical sequences throughout successive series of securities.

With securities usually printed in arrays on a substrate, several difficulties arise when one wants to build bundles and packs of individual securities which are numbered in sequence. A first problem resides in that each sheet or web segment has to be cut into individual securities. In order to maintain a proper production speed and efficiency, a run of sheets (usually hundred sheets) are piled up and cut together by appropriate cutting devices so as to process the piles into individual bundles of securities. Accordingly, numbering of full sheets has to be carried out so that the numerical sequence remains uninterrupted throughout each bundle. This is ensured by numbering each run of hundred successive sheets so that the serial number at each numbering location on the sheets is incremented or decremented by one unit from the first sheet until the hundredth and last sheet of each run.

Another difficulty arises when one wishes to form packs of bundles while keeping the numerical sequence throughout each pack. Depending on the type of numbering devices used to carry out numbering and on the numbering method used, more or less complex bundle collating systems must be implemented in order to collect and pile the bundles in the appropriate sequence.

In particular, when mechanical numbering devices are used to carry out numbering, which numbering devices can only be actuated in a sequential manner from one numbering iteration to the next as mentioned above, rather complex bundle collating systems must be implemented to collect and store the bundles in the appropriate manner to form packs of bundles with uninterrupted numerical sequence. Such bundle collating systems are for instance described in U.S. Pat. No. 3,939,621, U.S. Pat. No. 4,045,944, U.S. Pat. No. 4,453,707, U.S. Pat. No. 4,558,557, European patent applications Nos. EP 0 656 309, EP 1 607 355, British patent application GB 2 262 729 and International application WO 01/49464.

Depending on the number of securities on each sheet and on the sheet layout, bundle collating can be simplified to some extent. This is for example possible when the number of securities per sheet is a multiple of ten as disclosed in European patent application No. EP 0 598 679. With this solution, a plurality of bundles with consecutive numerical sequences are located within a same stack of sheets, for instance in each column, thus enabling collating of bundles on a column-by-column basis. Nevertheless, with this numbering approach, one still derives several groups of bundles with distinct numerical sequences from each processed stack of sheets (i.e. one sequence per column), and a collating system is therefore still required. In any case, this numbering approach is not applicable to cases where sheets comprise a number of security prints that is not a multiple of ten.

Non-collating numbering approaches which do not require a collating system are known in the art. With such non-collating solutions, numbering of the sheets has to be carried out in a specific manner that depends on the sheet layout, especially the number of security prints per sheet. This particular numbering principle is disclosed in International application No. WO 2004/016433. With such a numbering principle, all bundles derived from a given stack of sheets correspond to one complete consecutive numerical sequence, i.e. a stack of sheets with M×N security prints yields M×N bundles numbered in sequence, that is M×N×100 security papers numbered in sequence. The above numbering scheme enabling non-collating processing of stacks of sheets requires specific numbering devices which are usually more expensive that conventional mechanical numbering devices.

An important issue which is involved in full-sheet numbering processes is accordingly the design and resulting numbering flexibility of the numbering devices used to print the proper serial numbers on each numbering location of the sheets. Numbering devices typically comprise several typographic numbering wheels or disks having alpha-numerical symbols engraved in relief on their circumference, which numbering wheels are actuated by associated mechanical actuating means for rotating the wheels to the appropriate numbering positions.

Besides the usual mechanical numbering devices wherein the numbering wheels are sequentially-actuated, there exists another category of numbering devices which provide more flexibility as to the way the numbering wheels are or can be actuated from one numbering iteration to the next.

A numbering device with freely adjustable numbering wheels is disclosed for example in U.S. Pat. No. 5,660,106, the content of which is incorporated by reference in the present application. This patent discloses a numbering device wherein all the numbering wheels are rotatable about a common driving shaft and are driveable by means of a slip coupling with the driving shaft and wherein electro-magnetically-actuated pawls are provided to selectively block any one of the numbering wheels in the desired position. This numbering device has the advantage that selectively and arbitrary, even non-sequential, numbers can be formed at any time, allowing in particular a non-unitary skip of numbers from one numbering iteration to the next. This numbering device can in particular be used to implement the numbering scheme disclosed in WO 2004/016433. For a detailed explanation of the functioning of this numbering device, reference is made to the entire disclosure of U.S. Pat. No. 5,660,106. Disadvantages of this numbering device however reside in the relatively complex actuation mechanism and related costs, as well as in the build-up of excessive heat caused by friction between the numbering wheels and the common driving shaft.

A somewhat similar but more complicated numbering device than that described in U.S. Pat. No. 5,660,106 is disclosed in German patent application No. DE 30 47 390. One disadvantage thereof resides in the fact that it is slow and only allows rotation of the numbering wheels in one direction.

A hybrid numbering device is disclosed in U.S. Pat. No. 4,677,910, mainly in FIGS. 6 and 6*a* thereof, the corresponding description being incorporated herein by reference for the sake of explanation. This numbering device partly overcomes the limitation of purely sequential numbering devices by replacing the mechanical numbering wheel for the units digits with a numbering wheel which is kinematically independent from the other numbering wheels and driven by an electric motor. The flexibility of this numbering device is however greatly limited as only one numbering wheel (namely the units wheel only) can be set to any desired position, while the other numbering wheels remain sequentially-actuated.

Another hybrid numbering device is disclosed in International application WO 2004/016433, already mentioned hereinabove and the content of which is incorporated by reference in the present application. In this numbering device, the wheels for the unit digits and ten digits are actuated in a sequential manner (i.e. by purely mechanical actuation means), whereas at least the wheels for the hundred and thousand digits are actuated in an independent manner to allow the skipping of numbers during numbering. This construction allows to carry out the specific numbering process mentioned hereinabove which enables non-collated processing of the bundles.

U.S. Pat. No. 4,843,959 (which corresponds to European patent application EP 0 286 317 A1) discloses, with reference to FIGS. 3 to 6 thereof, another hybrid numbering device in which six numbering wheels out of ten (that is the numbering wheels for the units, tens, hundreds, thousands, ten thousands and hundred thousands) are all driven by respective stepping motors through gearings and shafts. Each motor incorporates a position sensing device, e.g. a shaft encoder for proper control of the operation of the motors, and feedback from the sensing devices to a computer enables the computer to verify the settings of the numbering wheels. The remaining four numbering wheels carry the individual indicia for the prefixes or suffixes, and no description is given regarding the means used to drive said wheels.

One major disadvantage of this solution resides in the fact that a maximum of six numbering wheels, not more, can be driven into rotation by the disclosed arrangement of stepping motors, gearings and shafts.

Another disadvantage resides in the fact that the motors are and can only be located outside the sidewalls of the numbering device, preventing side-by-side use of multiple numbering devices or at least greatly restricting the ability to dispose multiple numbering devices one next to the other in a compact manner, which is particularly critical in the context of full-sheet numbering of securities. Indeed, the six motors are arranged per pairs with the shafts of the motors of each pair facing each other.

Still another problem of the solution described in U.S. Pat. No. 4,843,959 resides in the fact that the gearings used to drive the numbering wheels into rotation all have the same diameter, and that there is accordingly no reduction factor between the motor output and the numbering wheels. In other words, the precision of this numbering device, as well as the rotational speed and torque will be directly dependent on the characteristics of the motor. As stepping motors are used, this in particular implies a very high number of steps per turn for the motor, which translates into motors having very large dimensions that are difficult to integrate within the numbering device itself.

Depending on the number of security prints on each sheet and on the sheet layout, mechanical numbering devices with sequential actuation can be envisaged to carry out numbering according to the numbering scheme of WO 2004/016433. This is again possible only when the number of security prints on each sheet is a multiple of ten (or of twenty-five) and by designing the numbering devices in a specific manner. One such solution is disclosed in International application No. WO 2005/018945. Another alternate solution is disclosed in European patent application 1 731 324 filed on Jun. 8, 2005 in the name of the present Applicant and entitled "NUMBERING PROCESS FOR SECURITIES, METHOD FOR PROCESSING THE NUMBERED SECURITIES AND NUMBERING DEVICE TO CARRY OUT THE NUMBERING PROCESS". As before, such solutions are not applicable to cases where sheets comprise a number of security prints that is not a multiple of ten or of twenty-five.

A disadvantage of the numbering devices described in U.S. Pat. No. 5,660,106, DE 30 47 390, U.S. Pat. No. 4,677,910, WO 2004/016433, WO 2005/018945, and EP 1 731 324 resides in the fact that, as with conventional mechanical numbering devices, the numbering devices mechanically interact with actuation means that are not part of the numbering devices per se and which are typically mounted on the numbering machine where the numbering device are disposed. In particular, each numbering device requires an actuation cam member for actuating or at least releasing the numbering wheels, which cam member cooperates with a corresponding cam surface placed in the numbering press. In some of the proposed solutions, driving into rotation of the numbering wheels further requires a mechanical coupling, such as the solution described in U.S. Pat. No. 5,660,106 which necessitates a driving gear wheel and an associated toothed segment.

SUMMARY OF THE INVENTION

An aim of the invention is to improve the known devices and methods.

It is a further aim of the present invention to provide a numbering device that is able to carry out any numbering method.

Another aim of the present invention is to provide a numbering device that is simple to fabricate and that has a small size.

Still another aim of the present invention is to provide a numbering device that is reliable.

These aims are achieved thanks to the device defined in the claims.

There is accordingly provided a numbering device for carrying out numbering in sheet-fed or web-fed numbering presses, the numbering device comprising a numbering unit with rotatable numbering wheels carrying alpha-numerical symbols thereon, which numbering wheels are disposed next to each other and rotate about a common rotation axis, the numbering device further comprising electro-mechanical actuation means for setting the position of the numbering wheels. According to the invention, the electro-mechanical actuation means are entirely located within the numbering device and are mechanically autonomous (i.e. do not require any external mechanical coupling for actuating the numbering wheels), the electro-mechanical actuation means comprising a plurality of independent driving means for actuating a corresponding plurality of the numbering wheels.

According to an advantageous embodiment of the invention, the numbering device comprises more than six rotatable numbering wheels actuated by a corresponding number of independent driving means. Advantageously, the numbering device comprises up to twelve such rotatable numbering wheels with independent driving means.

According to another embodiment of the invention each driving means at least comprises an electric motor driving the associated numbering wheel through a gearing, the electric motor being preferably coupled to the gearing via a reduction gear. This electric motor is preferably a brush-less DC motor with electronic commutation. A reduction factor between an output of the electric motor and the corresponding numbering wheels is selected to be such that a positional resolution of the numbering wheel, measured at its periphery, is of the order of 0.1 to 0.15 mm or less. According to a preferred embodiment of the invention, this is achieved by a selected combination of a reduction gear and of pinions and gear wheels with carefully-chosen dimensions and number of teeth.

According to another aspect of the invention the driving means are distributed about the rotation axis of the numbering wheels, advantageously such that adjacent means are disposed head-to-tail. In that context, a first part of the driving means can be supported on one side of the numbering device while a remaining part of the driving means is supported on the other side of the numbering device, the driving means being disposed so that the said first part and the said remaining part nest one between the other in the manner of two interlocked comb-structures. Preferably, the driving means are mounted on two symmetrical semi-circular comb-shaped parts.

An advantage of the present invention resides in the fact that actuation of the numbering device does not require any mechanical interaction with external actuation means. According to the invention, the electro-mechanical actuation means are mechanically autonomous and actuation only requires an electrical connection with the numbering device. The electro-mechanical actuation means are moreover completely located within an inner space of the numbering device, thus forming a very compact arrangement.

Moreover, the numbering device of the present invention is a truly flexible numbering device which is adapted to carry out any numbering process. According to the preferred embodiment of the invention, up to twelve distinct numbering wheels can be actuated in an independent manner, which number could not be achieved before with the numbering devices of the prior art.

Not only is this numbering device truly flexible, but such flexibility is not made at the costs of an increase in size of the numbering device. As a matter of fact, the preferred embodiment of the invention with up to twelve independently-driven numbering wheels is comparatively smaller than the prior art numbering devices with electro-mechanical actuation.

Advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1:
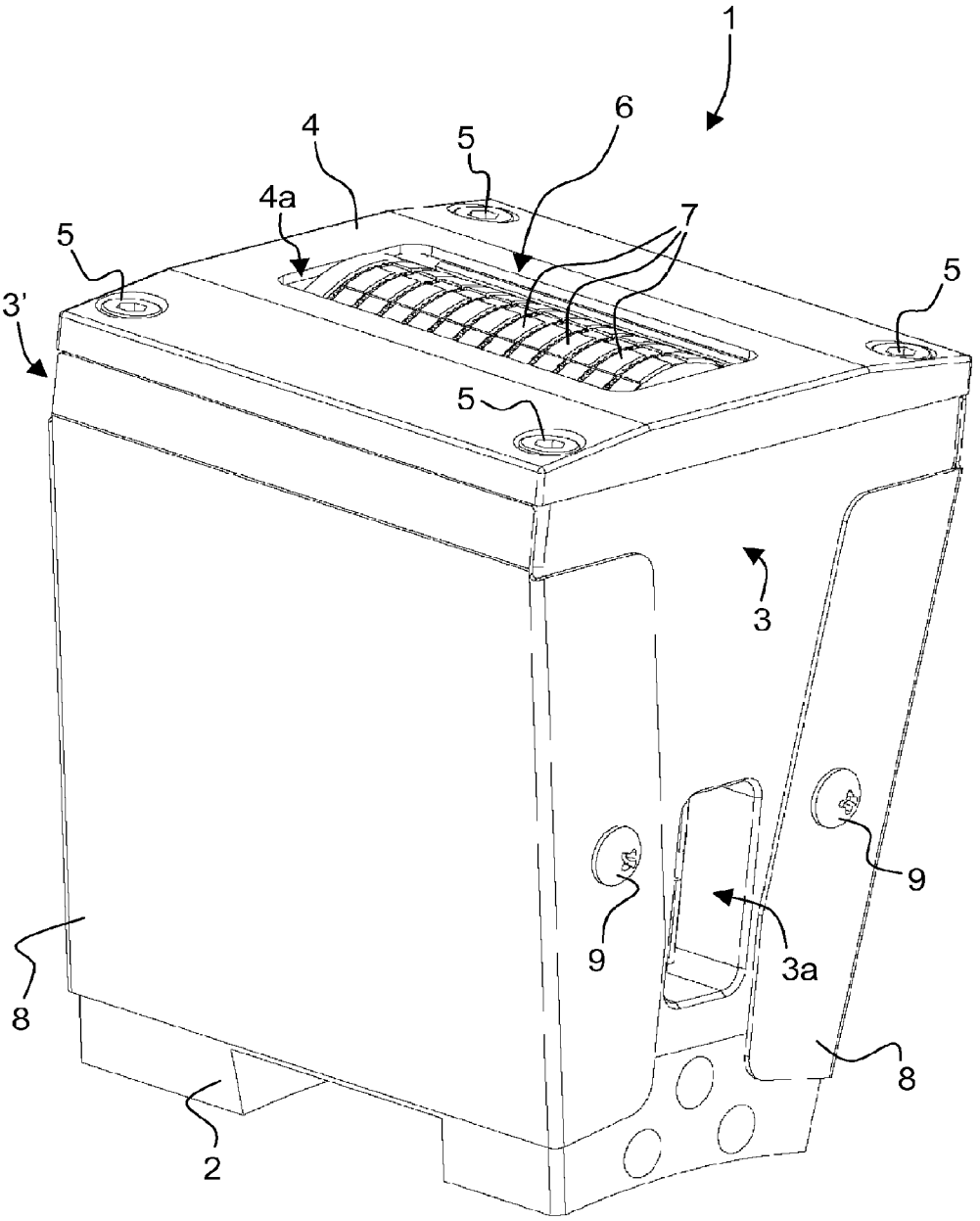
FIG. 1 shows a first general perspective view of an embodiment of a numbering device according to the invention.

FIG. 1 shows a first general perspective view of an embodiment of a numbering device 1 according to the invention. The numbering device comprises a casing with a bottom frame part 2 and a two-piece lateral frame part 3, 3'. The two-piece lateral frame part comprises two side frame parts 3 and 3' (side frame part 3' being not visible in FIG. 1) which are secured at their bottom ends to the bottom frame part 2 by means of screws 25 (visible in FIGS. 2 and 4). In the embodiment of FIG. 1, the upper part of the numbering device 1 is covered by a top cover member 4 which is secured to the side frame parts 3, 3' through top screws 5. The cover member 4 is provided with an opening 4*a* through which emerges part of a numbering unit 6 comprising several numbering wheels or disks 7 disposed next to each other for rotation about a common rotation axis as this will be explained in a more detailed manner hereinafter.

The numbering device 1 is also covered on its sides by protective side cover members 8 mounted onto the side frame parts 3, 3' through side screws 9. While only two side screws 9 are visible in FIG. 1, it shall be appreciated that two other side screws are provided on the opposite side of the numbering device 1 in order to similarly secure the side cover members 8 in position.

Figure 2:
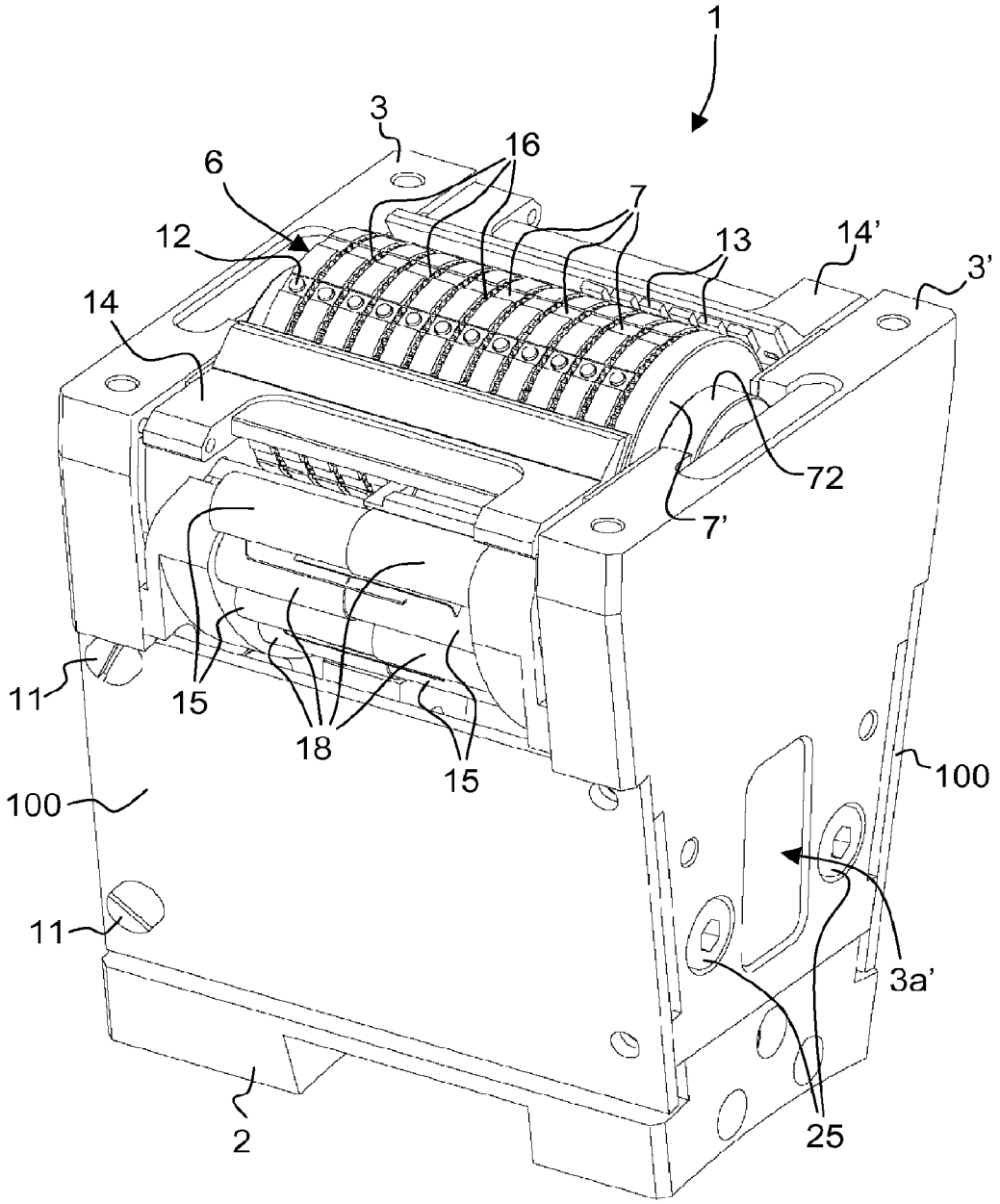
FIG. 2 is a second perspective view of the embodiment of FIG. 1 where certain cover parts have been omitted.

In FIG. 2, the two side cover members 8 and the top cover member 4 have been omitted with a view to better show the arrangement of the components located within the inner space of the numbering device 1. In this FIG. 2 one can see the screws 25 for securing side frame part 3' to bottom frame part 2, similar screws being provided on the other side for securing side frame part 3 as illustrated in FIG. 1. On the lower half of the numbering device 1, there are two boards 100 (one on each side of the numbering device 1) each mounted on the side frame parts 3 and 3' of the numbering device 1 by means of screws 11. Boards 100 are printed circuit boards which carry part of the control electronics used for controlling operation of the numbering device 1.

As represented on the top side of the numbering device 1, the numbering unit 6 carries several rotatable numbering wheels 7 disposed next to each other about a common rotation axis. In the illustrated embodiment, the numbering unit 6 comprises twelve numbering wheels 7, and one extra dummy wheel 7'. The purpose of the dummy wheel 7' is to ensure that the numbering unit 6 exhibits a determined length and symmetry for adequate positioning of the numbering unit 6 between the two side frame parts 3 and 3'. Each numbering wheel 7 carries alpha-numerical symbols such as a series of numbers (typically 0 to 9) and/or a series of letters (for example A, B, C etc). Such symbols are used to number printed securities (as has been explained above in a detailed manner). Besides the above-mentioned symbols, and depending on the application, the numbering wheels 7 may also be provided with a cancellation index for printing a cancellation mark and/or an empty index for not printing any symbol and leaving an empty space during printing. In addition, each numbering wheel 7 carries at least one magnet 12 for calibration purposes, each magnet 12 being designed to cooperate with a corresponding detector 13 (for example a Hall effect detector) carried by a supporting member 14, 14'. In the example of FIG. 2, six detectors 13 are carried by supporting member 14', and six other detectors (not visible in FIG. 2) are carried by supporting member 14. The purpose of the magnets 12 and detectors 13 is to calibrate the position of each numbering wheel 7 about the rotation axis and to ensure that each numbering wheel 7 can be brought to any of the desired numbering positions. Supporting members 14, 14' are mounted between the side frame parts 3, 3' and can be rotated backwards from their illustrated positions away from the numbering unit 6 once the top cover member 4 is removed, thereby enabling assembling or disassembling of the numbering unit 6. Of course, it is possible to place all necessary detectors 13 on the same supporting member 14 (or 14'). Other equivalent means could be envisaged to perform the positional calibration of the numbering wheels, such as encoder wheels (or the like) integrated with the numbering wheels 7.

As this will be explained in greater detail hereinafter, each numbering wheel 7 is actuated in an independent manner by means of associated driving means. In FIG. 2, part of these independent driving means are already visible, including electric motors 15.

Figure 3:
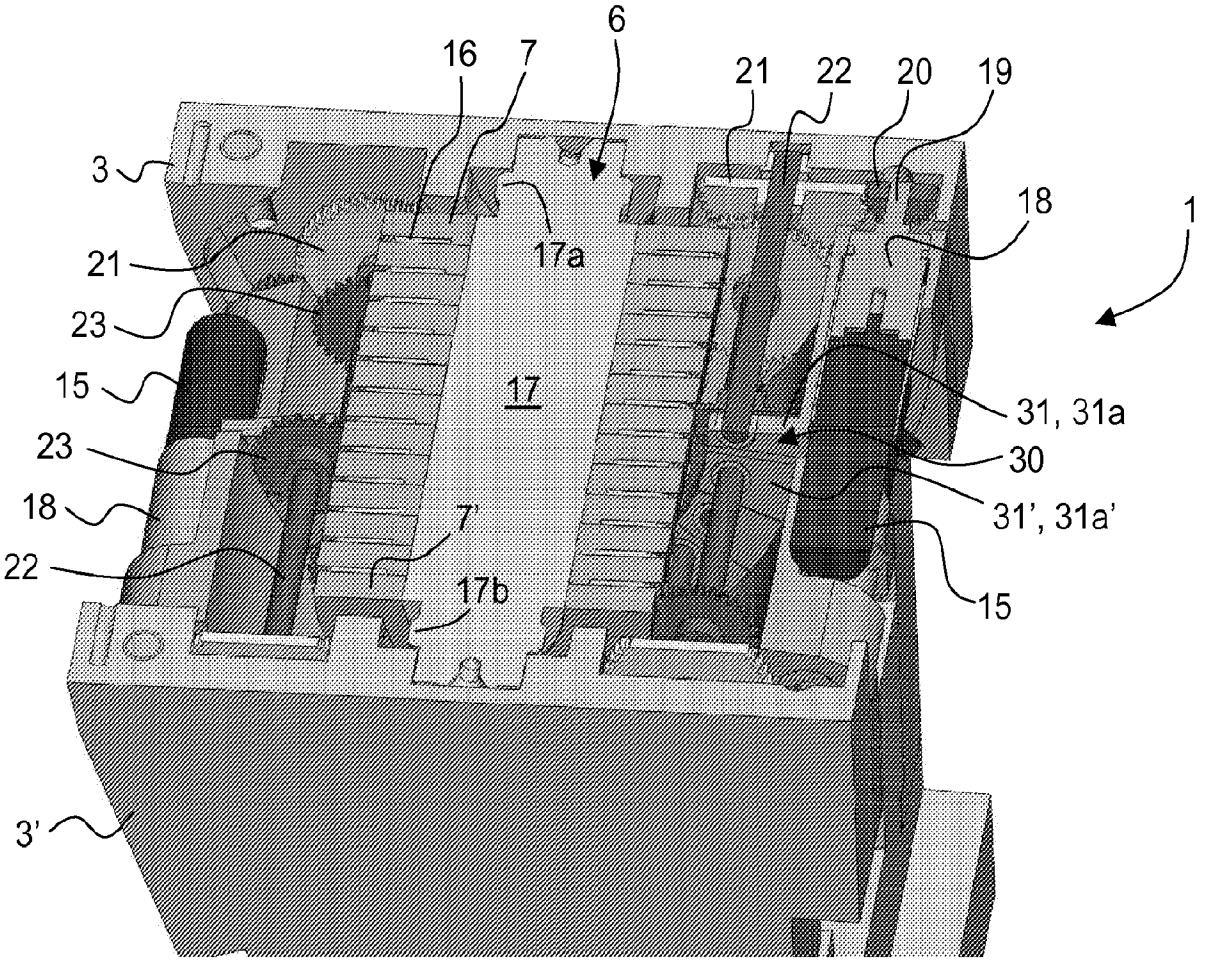
FIG. 3 shows a partial cross-section view in perspective of the embodiment of FIG. 1.

FIG. 3 shows a partial cross-section view in perspective of the numbering device 1 taken horizontally through the rotation axis of the numbering wheels 7 and which illustrates in a more detailed manner the electro-mechanical actuation means which are used for setting the position of the numbering wheels 7. As already mentioned, one shall appreciate that the electro-mechanical actuation means of the numbering device are entirely located within the numbering device, i.e. are disposed in an inner space of the casing of the numbering device. As illustrated in FIG. 3, the numbering wheels 7 are mounted for rotation about a common shaft 17 which is supported at both ends onto bearings provided in the side frame parts 3 and 3'. The numbering wheels 7 are held onto the common shaft 17, together with the dummy wheel 7', by means of a pair of holding rings 71, 72 (which are not illustrated in FIG. 3 but are visible in FIGS. 2, 4, 8*c* and 9*c*), which holding rings 71, 72 are secured to threaded end portions 17*a*, 17*b* of the common shaft 17. The numbering wheels 7 are mounted such as to be freely rotatable about the common shaft 17 between the holding rings 71, 72. It will be understood that the common shaft 17 does not rotate.

Figure 7:
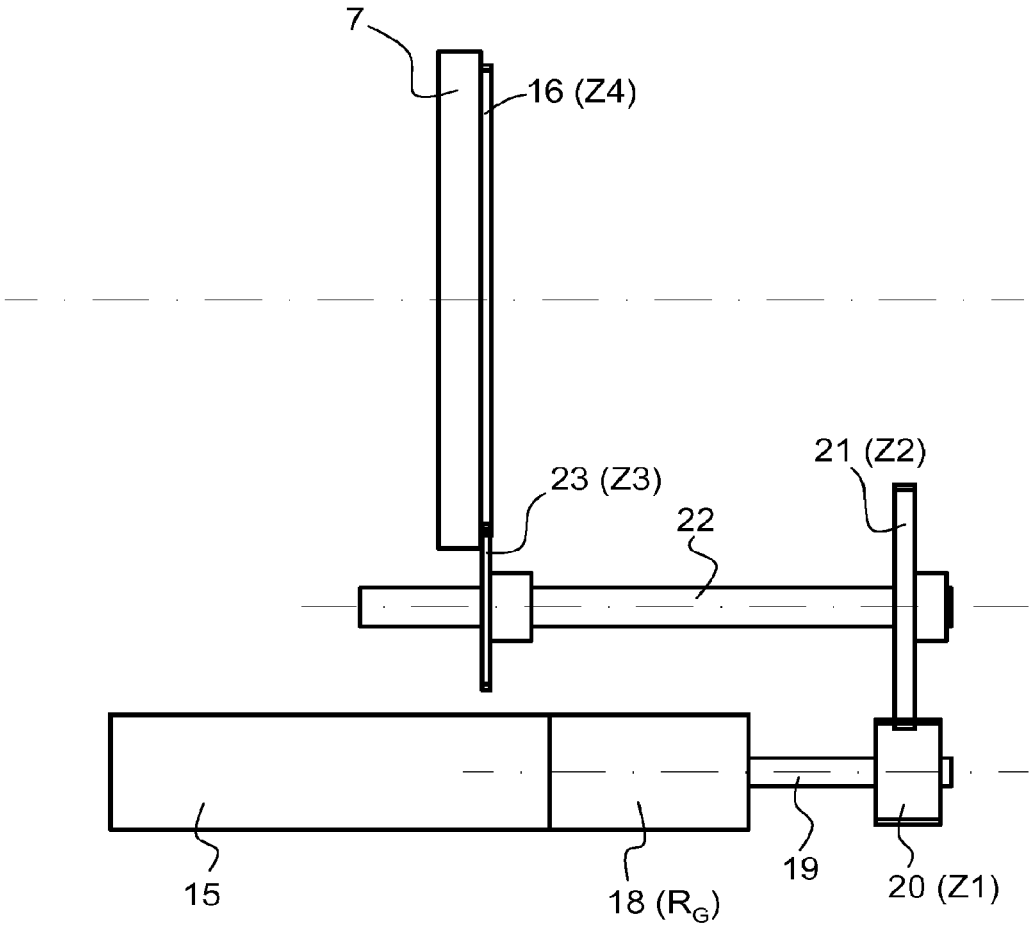
FIG. 7 is a schematic view of the kinematic driving chain between a numbering wheel and its associated driving means.

Each said numbering wheel 7 is preferably driven into rotation by an electric motor 15 coupled to a gear-wheel assembly 19, 20, 21, 22, 23 (also shown schematically in FIG. 7). To this end, each numbering wheel 7 is provided with a toothed wheel 16 which is designed to rotate together with the numbering wheel 7. The numbering wheel 7 and toothed wheel 16 could either be formed as two separate parts secured to one another or as a single part. The twelve toothed wheels 16 are visible in FIGS. 2 and 3 between the numbering wheels 7. In the illustrated embodiment, the electro-mechanical actuation means for actuating the numbering wheels 7 thus comprise twelve motors 15, twelve gear-wheel assemblies 19-23 and twelve toothed wheels 16 (i.e. one for each numbering wheel 7). Preferably, each motor 15 is associated to a reduction gear 18, the purpose of which will be explained hereinafter. The reduction gear 18 has an output shaft 19 carrying a first pinion 20 which meshes with a gear wheel 21 mounted on an intermediate shaft 22, said intermediate shaft 22 being driven into rotation by the gear wheel 21. On the intermediate shaft 22, there is also mounted a second pinion 23 that meshes with the toothed wheel 16 of the corresponding numbering wheel 7. Accordingly, each numbering wheel 7 is driven into rotation by its own independent drive mechanism as described hereabove and can be set to any desired position independently from the other numbering wheels 7.

In the following description (as well as in the claims), the assembly comprising the motor 15, the optional reduction gear 18, and the gear-wheel assembly 19-23 will be referred to as the "driving means" for driving the associated toothed wheel 16 and numbering wheel 7 into rotation. In the illustrated embodiment, there are accordingly twelve independent driving means.

It will be appreciated that each gear-wheel assembly 19-23 and associated toothed wheel 16 form a two-stage gearing as schematically illustrated in FIG. 7. This two-stage gearing exhibits a determined reduction factor that depends on the ratios between the number of teeth of the pinions 20, 23, of the gear wheel 21 and of the toothed wheel 16. More precisely, the reduction factor $R_Z$ of the two-stage gearing 16, 19-23 will be given by the following expression where Z1, Z2, Z3, Z4 are respectively the numbers of teeth of the first pinion 20, of the gear wheel 21, of the second pinion 23 and of the toothed wheel 16:

$$R_Z=(Z2*Z4)/(Z1*Z3) \quad (1)$$

As mentioned hereinabove, each motor 15 is preferably coupled to the two-stage gearing 16, 19-23 via a reduction gear 18. This reduction gear 18 provides an additional reduction of the output speed and an additional increase of the output torque of the motor 15. The reduction gear 18 also exhibits a reduction factor which will be referred to as $R_G$. The overall reduction factor R between the output of the motor 15 and the associated numbering wheel 7 will thus be given by the following expression:

$$R=R_G*R_Z=R_G*(Z2*Z4)/(Z1*Z3) \quad (2)$$

It will be appreciated that if a reduction gear is omitted, the reduction factor $R_G$ in expression (2) above can be replaced by one. The embodiment of the numbering device 1 which is illustrated in the drawings was designed with a view to attain at least the following three main objectives:

1. as high as possible a positional resolution or accuracy of the numbering wheels 7;
2. as short as possible a commutation time for the numbering wheels 7 to move to the target positions;
3. as small and compact as possible a numbering device.

In the illustrated embodiment, these three main objectives are attained thanks to an adequate selection of the motors 15, of the reduction gears 18 and an appropriate dimensioning of the pinions 20, 23, of the gear wheel 21 and of the toothed wheel 16. The motors 15 and reduction gears 18 are preferably components manufactured and sold by company Maxon Motors AG in Switzerland (www.maxonmotor.com). More precisely, the motors 15 are preferably brush-less DC motors with electronic commutation, as manufactured by Maxon Motors AG under reference EC 6 (with a rotational speed of several thousands rpm) which are particularly well suited to the present application, while the reduction gears 18 are preferably miniature planetary gears, as manufactured by Maxon Motors AG under reference GP 6, both having a diameter of the order of 6 mm. The advantages of using brush-less DC motors with electronic commutation as compared to other types of motors, such as stepping motors, are multiple. First of all, friction and wear problems are limited to a big extent because of the brush-less configuration of such motors, thereby leading to a long life cycle. In addition, such motors can be miniaturized to a substantial extent while still providing a sufficiently high speed and high torque to meet the requirements of numbering applications.

The overall reduction factor between the output of the electric motor 15 and the corresponding numbering wheel 7 is selected to be such that a positional resolution of the numbering wheel 7, measured at its periphery, is of the order of 0.10-0.15 mm or less, in order to ensure a sufficiently fine adjustment of the position of the numbering wheels 7. For numbering wheels 7 having typical diameters of the order of 20 to 30 mm, this implies a resolution of several hundreds steps per turn (i.e. less than 1° angular resolution). For a given type of motor that is adapted to take, e.g. six different positions per revolution (such as Maxon's EC 6 motor), this yields an overall reduction factor in the range of one hundred, which reduction factor can easily be attained by means of the combination of the reduction gear 18 and the gearing 16, 19-23 mentioned hereinabove.

Referring again to the preferred embodiment of FIG. 3, it will be appreciated that each intermediate shaft 22 does not extend along the whole length between the two side frame parts 3, 3'. Rather, as represented in this FIG. 3, each intermediate shaft 22 is maintained between one of the side frame parts 3, 3' and an intermediate supporting wall 30. As this will be explained hereinafter, the intermediate supporting wall 30 is formed by end portions 31*a*, 31*a'* of two separate supporting pieces 31, 31' (see also FIGS. 5 and 6). Each intermediate shaft 22 is supported between a pair of bearings provided in side frame part 3 and supporting piece 31, respectively 3' and 31'.

Figure 4:
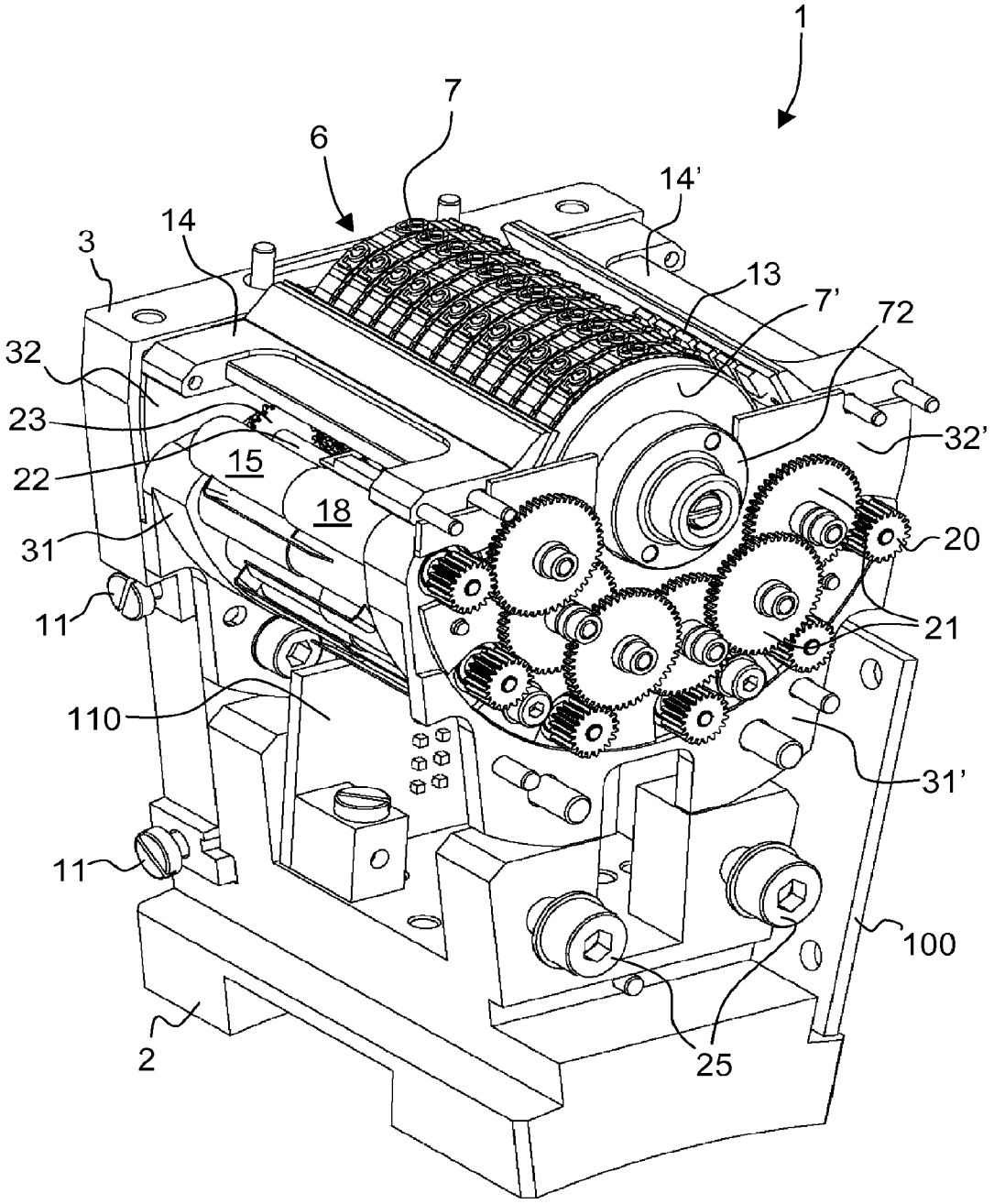
FIG. 4 shows another perspective view of the embodiment of FIG. 1 where part of the gearings used to drive the numbering wheels into rotation are apparent.

FIG. 4 illustrates another view of the numbering device 1. As can be readily understood from this view, side frame part 3' has been omitted to show some of the pinions 20 and gear wheels 21 of the gear-wheel assemblies. As already mentioned hereinabove, side frame parts 3 and 3' are mounted on the bottom frame part 2 by means of a pair of screws 25 which are visible in FIG. 4. In FIG. 4, one has also represented alpha-numerical symbols on the circumference of the numbering wheels 7 for the purpose of illustration (symbols "5" and "6" can be seen in this Figure).

In FIG. 4, an additional printed circuit board 110 is visible in the available space below the numbering unit 6 and the associated driving means 15, 18-23. This printed circuit board 110 is designed to be coupled to the previously-mentioned printed circuit boards 100 placed on the sides, by means of suitable electrical connectors, such as flexible connectors (not shown). All the control electronics required for controlling the operation of the numbering device 1 is preferably integrated on these printed circuit boards 100, 110. A multi-pole connector (not shown) coupled to the control electronics can advantageously be disposed in one of the openings 3*a* or 3*a'* provided in each one of the side frame parts 3, 3' (these openings 3*a*, 3*a'* are visible in FIGS. 1, 2, 5 and 6). By means of this connector placed in one of the side frame parts 3, 3', the control electronics of the numbering device 1 can be coupled to an external controller, especially the controller of a numbering press.

In FIG. 4, six pinions 20 and six gear wheels 21 are visible. It will be appreciated that the six remaining pinions 20 and gear wheels 21 are located on the opposite side of the numbering device 1. Indeed, in the illustrated embodiment, the driving means 15, 18-23 are distributed about the rotation axis of the numbering wheels 7 (under the lower part thereof) in an advantageous way by disposing adjacent driving means 15, 18-23 head-to-tail about the rotation axis of the numbering wheels 7. In the illustrated embodiment, this is achieved by supporting a first half of the driving means 15, 18-23 on one side of the numbering device 1 (namely on side frame part 3) and the remaining half of the driving means 15, 18-23 on the other side of the numbering device 1 (namely on side frame part 3'). More precisely, the driving means 15, 18-23 are disposed so that the first and second halves nest one between the other in the manner of two interlocked comb-structures (see also FIGS. 5 and 6). In FIG. 4, the pinions 20 and gear wheels 21 which are visible belong to the half that is supported on side frame part 3'.

In addition, as represented in FIG. 4, the six gear wheels 21 are advantageously disposed in two separate planes such that all six wheels 21 can be disposed within the available space. The six remaining gear wheels 21 are disposed in similar and symmetric manner on the opposite side of the numbering device 1.

The above configuration enables a very compact arrangement of the driving means allowing, in the illustrated embodiment, independent driving of up to twelve distinct numbering wheels 7, which could never be achieved before with prior art numbering devices. It will be appreciated that the numbering device according to the invention could however be provided with less than twelve independently-driven numbering wheels 7, providing greater space for locating the necessary driving means. Depending on the number of independently-driven numbering wheels it might be possible to dispose all the driving means on the same side of the numbering device, or to dispose more driving means on one side than on the other.

Figure 5:
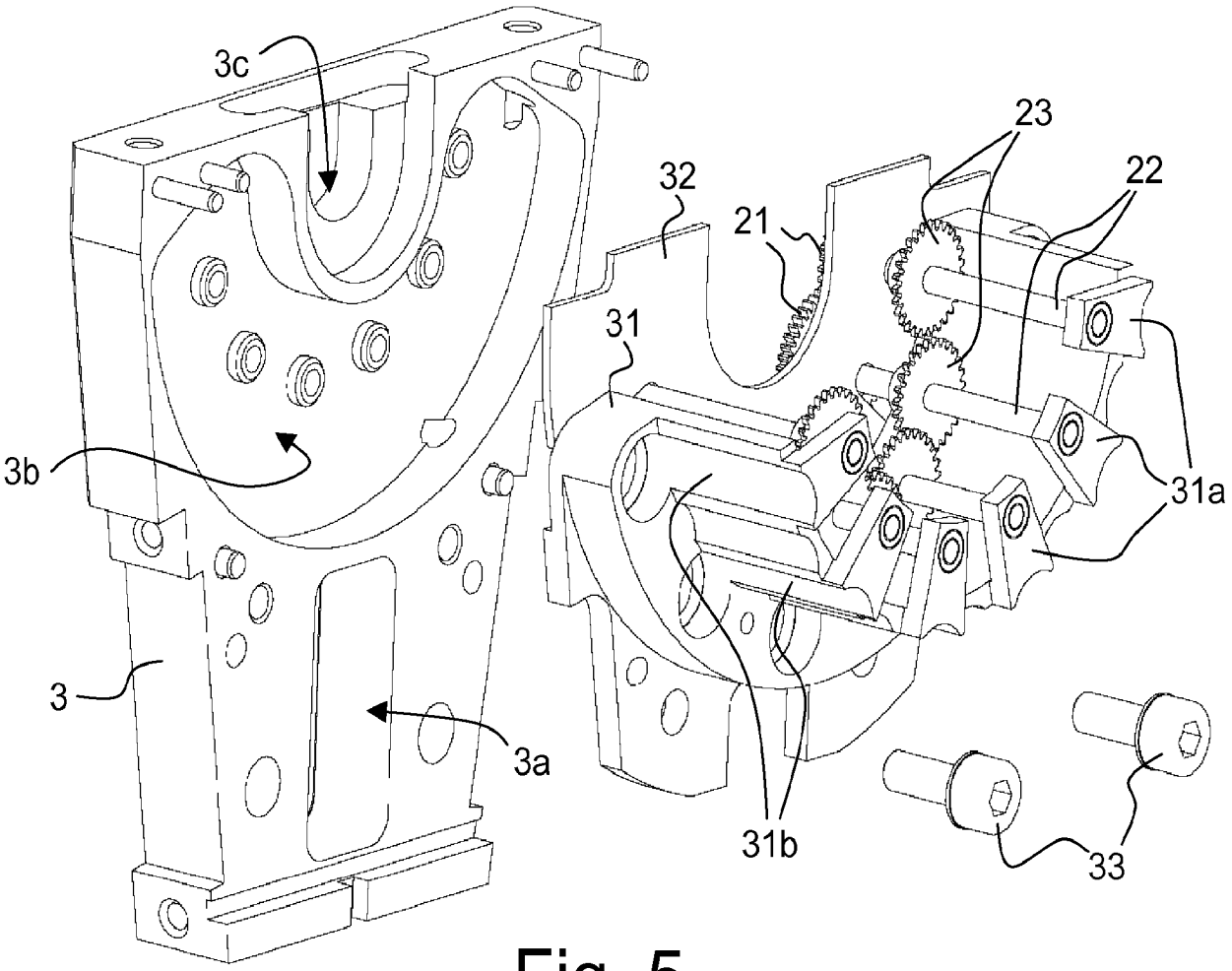
FIG. 5 is a partial exploded view in perspective of the embodiment of FIG. 1 showing one side frame part of the numbering device with its associated supporting piece for supporting part of the driving means used to drive the numbering wheels into rotation.
Figure 6:
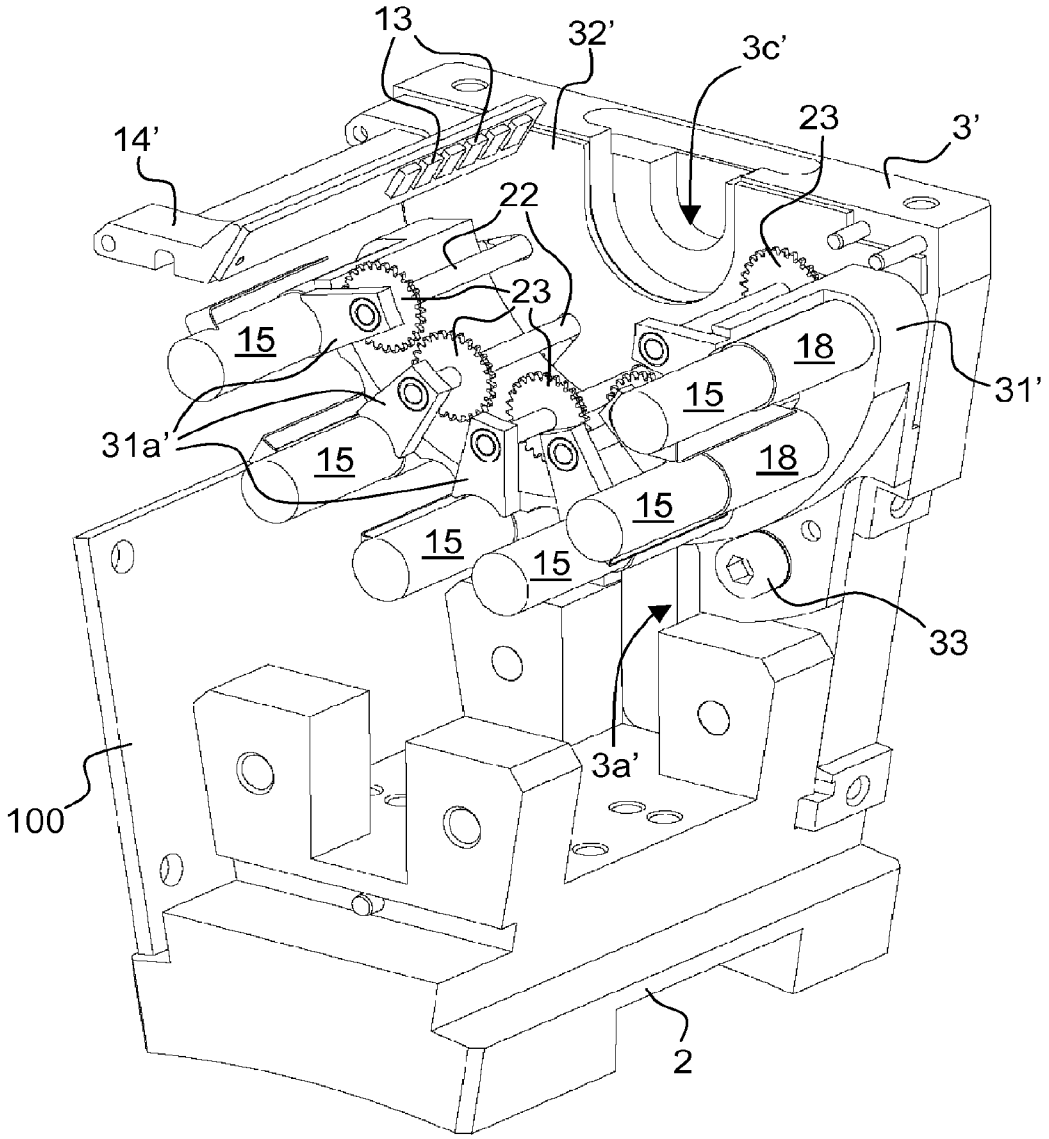
FIG. 6 is another partial exploded view in perspective of the embodiment of FIG. 1 showing the opposite side frame part of the numbering device with its other associated supporting piece for the driving means.

FIGS. 5 and 6 provide a better understanding of the arrangement of the driving means on each side of the numbering device 1. In these Figures, the numbering unit 6 has been omitted for the sake of clarity. FIG. 5 illustrates side frame part 3 and the associated supporting piece 31 for supporting the first half of the driving means 15, 18-23. In FIG. 5, the motors 15, associated reduction gears 18, output shafts 19 and first pinions 20 have been omitted to better illustrate the shape and configuration of the supporting piece 31. FIG. 6 illustrates side frame part 3' still secured to the bottom frame part 2 and provided with one of the printed circuit boards 100, as well as the second supporting piece 31' still secured to side frame part 3' with the supported driving means 15, 18-23.

The two supporting pieces 31, 31' are identical and are designed as two symmetrical semi-circular comb-shaped parts that can nest one between the other. Each supporting piece 31, 31' comprises six end portions 31*a*, 31*a'* each provided with a bearing for supporting one extremity of an intermediate shaft 22, the other extremity of the intermediate shaft 22 being supported, as already mentioned, in a bearing provided on the side frame part 3, 3', which bearings are illustrated in FIG. 5. When assembled together, the end portions 31*a*, 31*a'* of the supporting pieces 31, 31' form an intermediate supporting wall 30 as already mentioned in reference to FIG. 3.

A half-moon plate 32, 32' with an opening for passage of the shaft of the numbering unit 6 and opening slits for passage of the pinions 20 and associated shafts 19 and of the intermediate shafts 22 (see also FIG. 4) is interposed between the side frame part 3 and the supporting piece 31, respectively 3' and 31'. Recesses 31*b* dimensioned to receive the motors 15 with their reduction gears 18 are further provided on the supporting pieces 31, 31'. These recesses 31*b* are visible in FIG. 5 but hidden by the motors 15 and reduction gears 18 in FIG. 6.

As illustrated in FIGS. 5 and 6, the comb-shaped supporting pieces 31, 31' are mounted on the side frame parts 3, 3' by means of a pair of screws 33. A recess 3*b* (only visible in FIG. 5) is provided in each of the side frame parts 3, 3' to provide space for accommodating the first pinions 20 and the gear wheels 21, six bearings being provided within this recess 3*b* for holding the other extremity of the intermediate shafts 22.

As illustrated in FIGS. 5 and 6, pinions 23 are disposed in a staggered manner along the intermediate shafts 22, the position of the second pinions 23 being such that they mesh with the corresponding toothed wheels 16 of the numbering wheels 7. The position of the pinions 23 along the intermediate shafts 22 can be adjusted as a function of the width and/or axial position of the associated numbering wheels 7 on the common shaft 17. As a consequence, replacement of a numbering unit 6 by another numbering unit 6 equipped with numbering wheels having a different width and/or axial position is very easy, it being only necessary to adapt the position of the pinions 23 along the intermediate shafts 22.

On the upper part of each side frame part 3, 3', there is further provided a U-shaped recess 3*c*, respectively 3*c'* for receiving one extremity of the shaft 17 of the numbering unit 6 as shown in FIGS. 2 and 3.

Alternatively, and provided appropriate adaptations are made, the supporting piece 31 and side frame parts 3, respectively 31' and 3', could be designed as a single piece. Similarly, rather than providing a separate bottom frame part 2, this latter could be integrated with one of the side frame parts 3, 3' or, preferably, be subdivided into two halves integrated together with the side frame parts 3, 3' so as to reduce the number of individual parts and ease assembly of the numbering device 1.

Figure 10A:
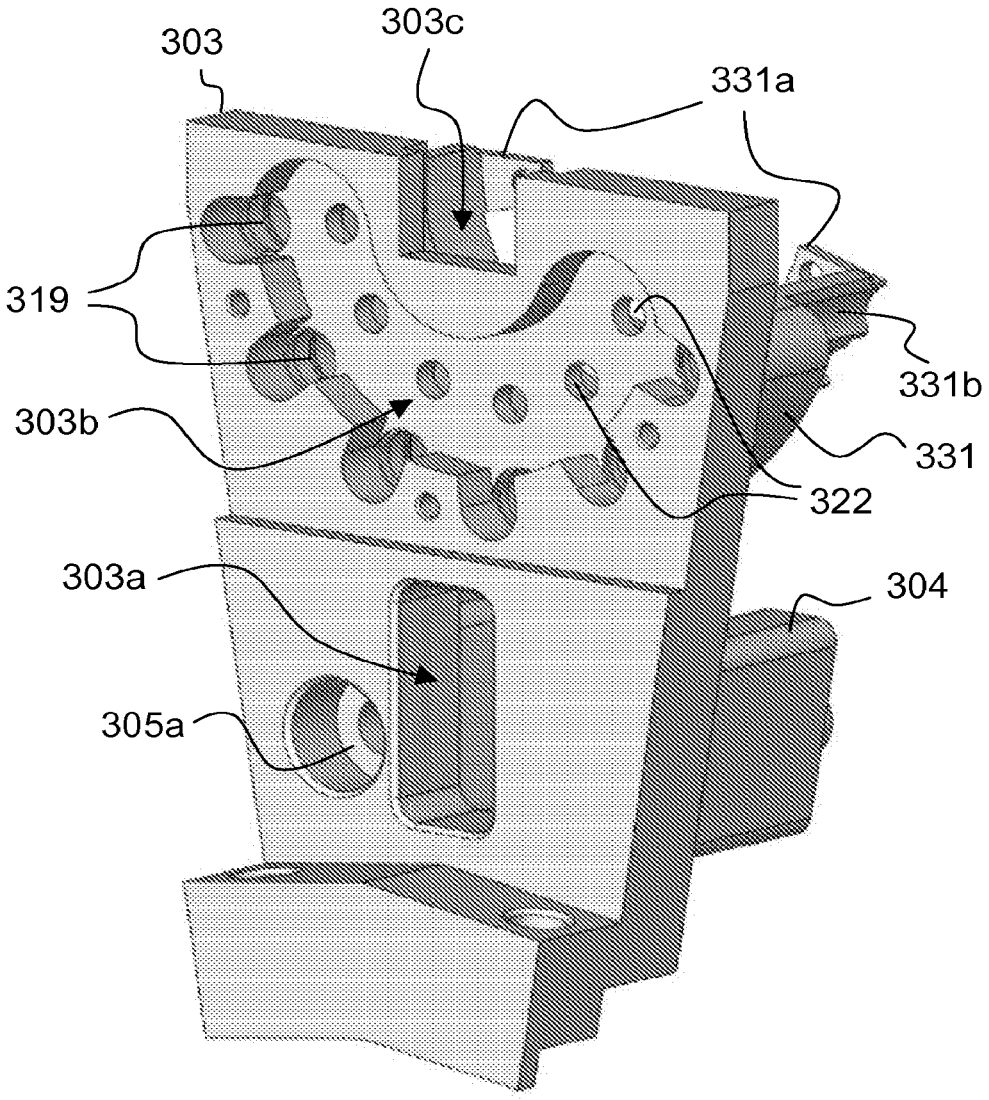
FIGS. 10*a* and 10*b* are views from two different perspectives of a frame part for a numbering device according to a second embodiment of the invention.
Figure 10B:
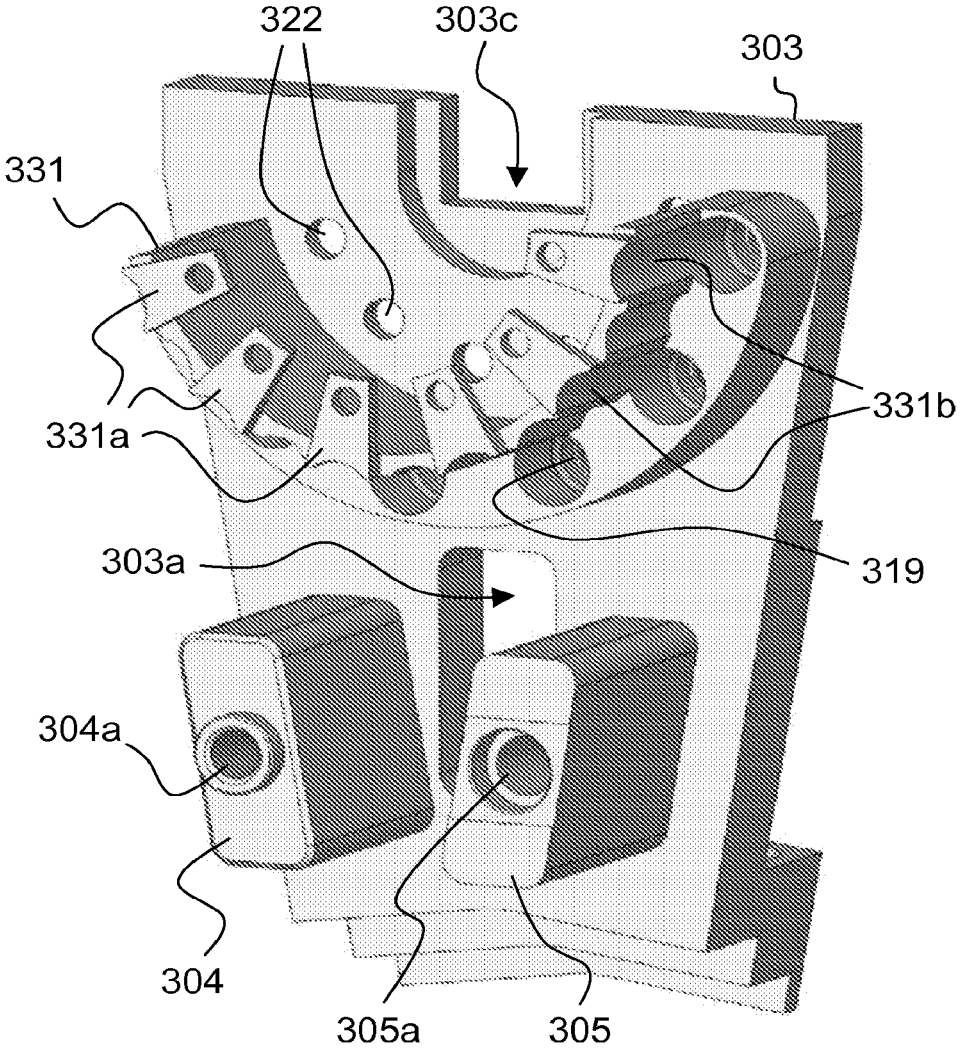
Figure 11:
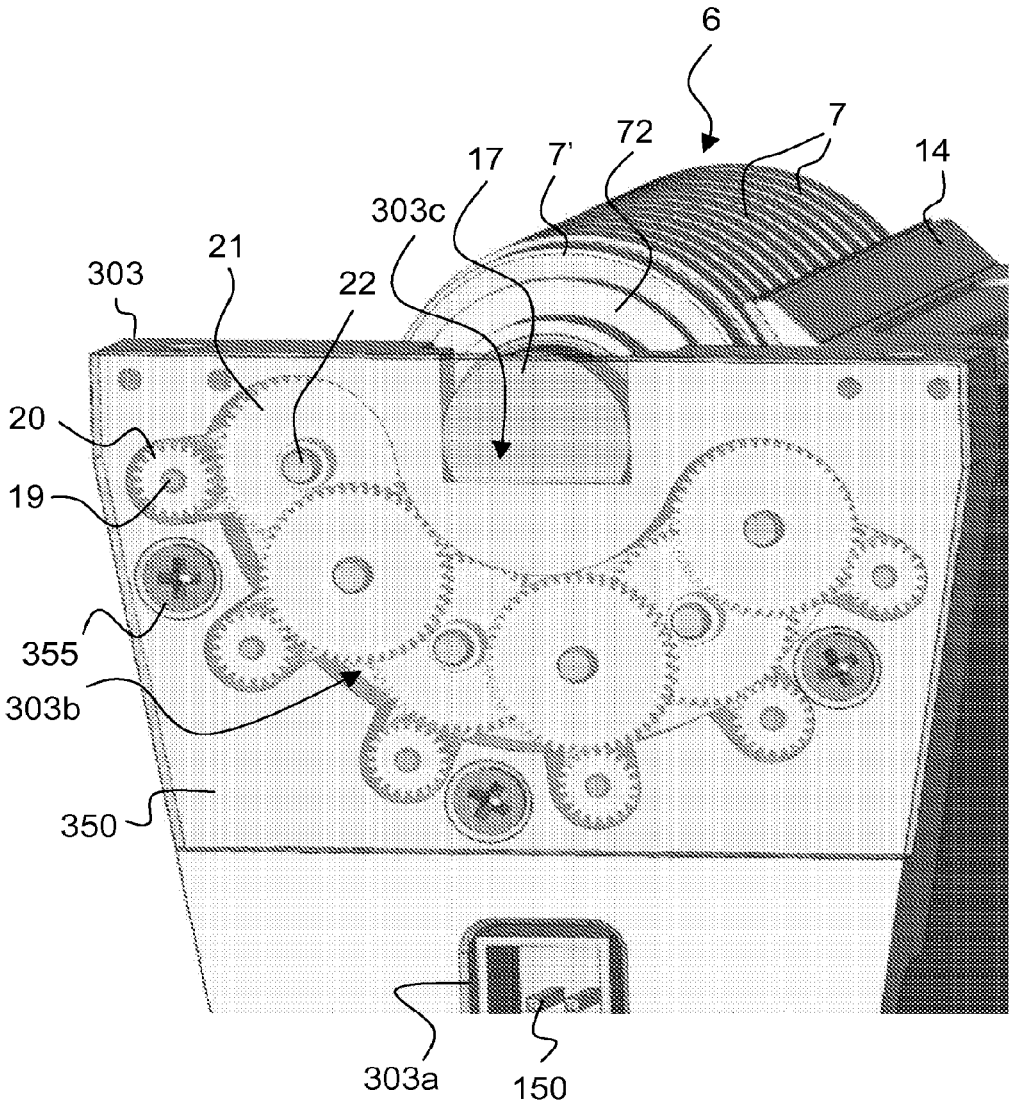
FIG. 11 is a partial perspective view of the numbering device according to the second embodiment of the invention.

Such an alternative is illustrated by FIGS. 10*a*, 10*b* and 11. FIGS. 10*a* and 10*b* are views from two different perspectives of a frame part designated by reference numeral 303. Two such frame parts might be secured one to the other in order to build a casing for the numbering device and support the above-mentioned numbering unit and driving means. As illustrated in FIGS. 10*a* and 10*b*, frame part 303 comprises a supporting portion 331 forming an integral part of frame part 303 for supporting one half of the driving means. This supporting portion 331 fulfils the same function as the above-described supporting piece 31, 31' and exhibits a semi-circular comb-shaped configuration with end portions 331*a* each provided with a bearing for supporting one extremity of the intermediate shaft 22 of the driving means and recesses 331*b* dimensioned to receive the motors 15 with their reduction gears 18. When two identical frame parts 303 are interlocked one with the other, the end portions 331*a* form an intermediate supporting wall in a manner similar to what has been discussed hereinabove in reference to FIG. 3.

Frame part 303 is further provided with two extensions 304, 305 that fulfil the same function as bottom frame part 2 of the previous embodiment when two frame parts are assembled together. To this end, extension 304 is provided with a threaded portion 304*a* (visible on FIG. 10*b* only) and extension 305 is provided with a through hole 305*a* for enabling passage of a screw (not illustrated). When two frame parts 303 are assembled, extensions 304 and 305 of one frame part cooperate respectively with extensions 305 and 304 of the other frame part, i.e. a screw can be disposed in the through hole 305*a* of the extension 305 of each frame part for cooperation with the threaded portion 304*a* of the extension 304 of the other frame part. Two screws are thus necessary in order to secure two frame parts 303 together.

Six through holes 319 and six through holes 322 are provided in frame part 303 at locations corresponding to the required passages of the output shafts 19 and intermediate shafts 22 of the driving means (or more exactly one half thereof) in a manner similar to the previous embodiment of FIGS. 1 to 6.

In contrast to the previous embodiment, a recess 303*b* is provided on an exterior face of frame part 303 (with respect to the location where the numbering unit is to be mounted) to provide space for accommodating the necessary gearing of the driving means, namely the first pinions 20 mounted on their corresponding output shafts 19 and the gear wheels 21 mounted on their corresponding intermediate shafts 22 (as illustrated more clearly in FIG. 11), the six through holes 322 acting as bearings being provided within this recess 303*b* for holding the other extremity of the corresponding intermediate shafts 22. As illustrated in FIG. 11, a cover plate 350 (which is shown as being translucent in this Figure for the purpose of illustration) is secured by means of three screws 355 to the exterior face of frame part 303 in order to cover and protect the first pinions 20 and gear wheels 21.

As illustrated in FIGS. 10*a*, 10*b* and 11, an upper part of frame part 303 is provided with a recess portion 303*c* for receiving an extremity of the common shaft 17 of the numbering unit 6. An opening 303*a* is also provided in the side of frame part 303 in order to enable the disposition of a multi-pole connector, partly shown in FIG. 11 and designated by reference numeral 150, which connector is coupled to the control electronics of the numbering device (see also FIGS. 15*a* and 15*b*) and enables coupling of said control electronics to an external controller, especially the controller of a numbering press.

Figure 12:
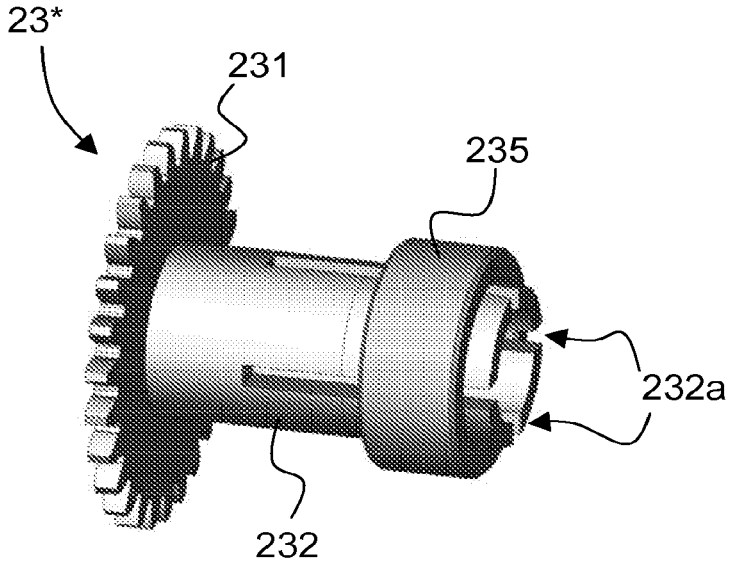
FIG. 12 is a perspective view of variant of a pinion of the driving chain of FIG. 7 which is equipped with a releasable clamping ring for adjustment of the axial position of the pinion on its associated shaft.
Figure 13:
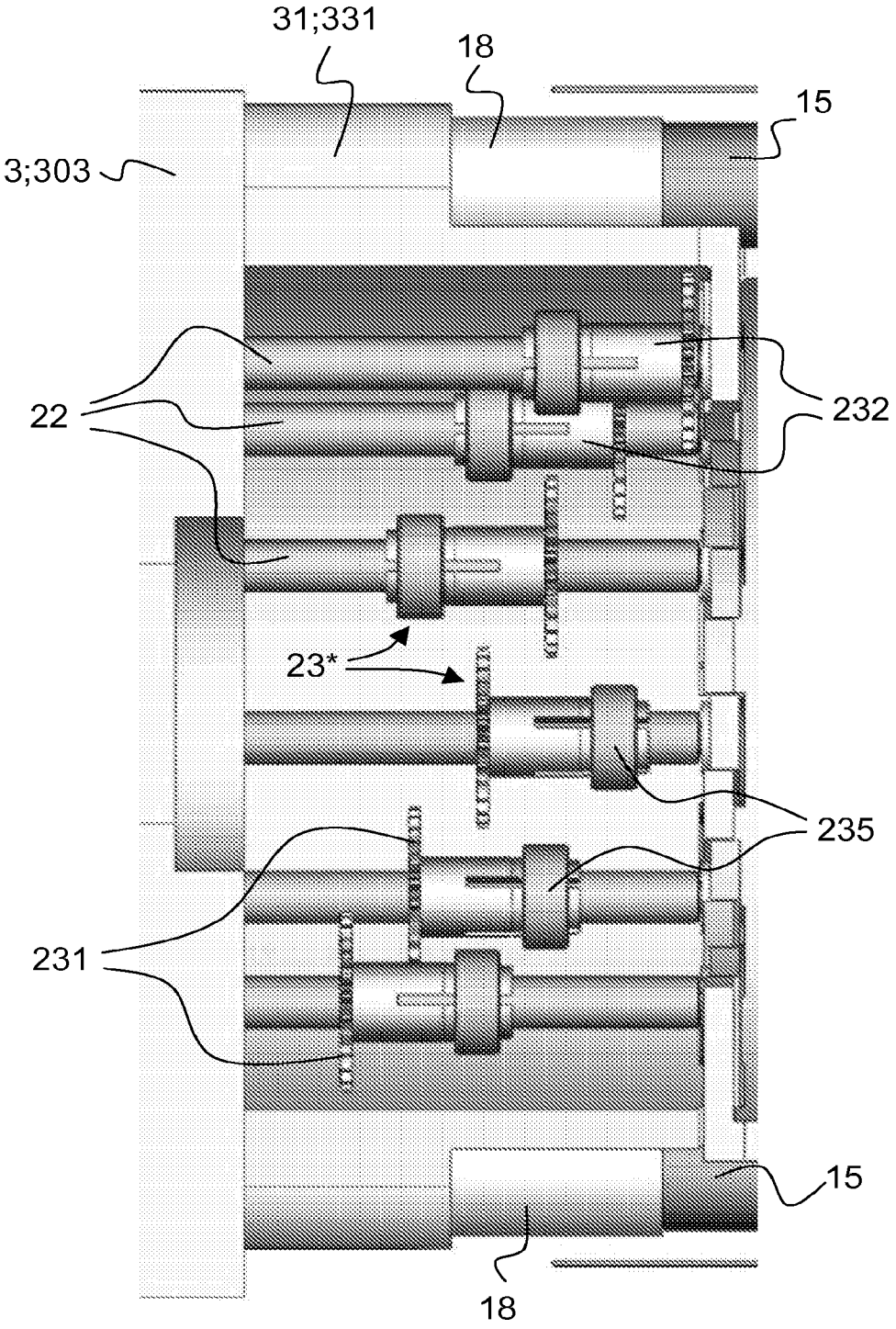
FIG. 13 is a partial top view showing six pinions of the type illustrated in FIG. 12 and their associate shafts mounted in the numbering device.

Let us now turn to FIGS. 12 and 13. FIG. 12 shows a perspective view of a variant of the second pinion of the driving chain of FIG. 7. According to this variant, the second pinion, designated globally by reference numeral 23* is equipped with a releasable clamping ring 235 for adjustment of the axial position of the pinion 23* on its associated shaft 22. To this end, the pinion 23* comprises a tubular portion 232 forming an integral part with a pinion wheel portion 231, which tubular portion 232 is provided at its extremity with four longitudinal slits 232*a*. These longitudinal slits 232*a* enable slight deformations of the extremity of the tubular portion 232 under the action of the releasable clamping ring 235. More precisely, the tubular portion 232 exhibits a slightly conical outer surface with a diameter of the tubular portion 232 decreasing towards the extremity thereof, i.e. where the longitudinal slits 232*a* are located. When the clamping ring 235 is positioned onto the extremity of the tubular portion 232, the clamping ring 235 causes a reduction of the diameter of the inner through hole of the tubular portion 232, i.e. effectively secures the pinion 23* on its shaft 22 at the desired axial location. When the clamping ring 235 is removed from the extremity of the tubular portion 232 (i.e. to the right in the configuration illustrated in FIG. 12), thereby releasing the clamping action of the tubular portion 232 on the corresponding shaft 22 on which the pinion 23* is mounted, the pinion 23* is allowed to slide on its shaft 22 and the axial position thereof can thus be adjusted.

FIG. 13 is a partial top view showing six pinions 23* of the type illustrated in FIG. 12 and their associate shafts 22 mounted in the numbering device. In this context, the casing of the numbering device can be built according to the first or second embodiments mentioned above, i.e. by means of side frame part 3,3' and supporting piece 31, 31' or by means of frame part 303 with its supporting portion 331. One will appreciate that the variant of FIG. 12 is advantageous in that the position of the pinions 23* along the intermediate shafts 22 can be easily adjusted as a function of the width and/or axial position of the associated numbering wheels 7 on the common shaft 17. As a consequence, replacement of a numbering unit 6 by another numbering unit 6 equipped with numbering wheels having a different width and/or axial position is very easy. This for instance enables the use of a numbering unit 6 equipped with numbering wheels of non-constant widths, opening new possibilities for the format and typeface of the alphanumerical symbols printable by the numbering device.

One will now turn to FIGS. 8*a*-8*c* and 9*a*-9*c* which illustrate two variants of a releasable indexing mechanism (or locking mechanism) for mechanically aligning and maintaining the position of the numbering wheels during a numbering operation. This index mechanism is not as such necessary but enables to guarantee, if necessary, an exact positioning of the numbering wheels 7 on their target positions. It shall be understood that this indexing mechanism is operative and cooperates with the numbering wheels once all the numbering wheels have been rotated to their target positions.

The two variants of the releasable indexing mechanism operate basically in the same way, namely by pushing a movable indexing member 50, 50' extending parallel to the axis of rotation of the numbering wheels 7 against indexing grooves 7*a*, 7*a'* provided on the numbering wheels 7. The only difference between the two variants resides in the fact that the indexing member 50, according to the first variant of FIGS. 8*a*-8*c*, cooperates with the outer circumference of the numbering wheels 7, outer indexing grooves 7*a* being provided between the numbering symbols, while, according to the second variant of FIGS. 9*a*-9*c*, the indexing member 50' cooperates with the inner circumference of the numbering wheels 7 where inner indexing grooves 7*a'* are provided.

Figure 8A:
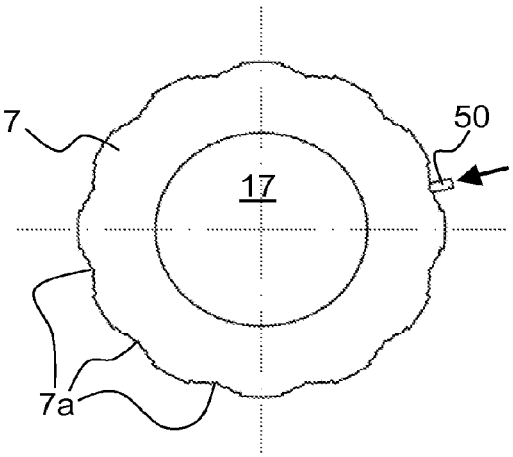
FIGS. 8*a*, 8*b* and 8*c* are views illustrating a first variant of a releasable indexing mechanism for mechanically aligning and maintaining the position of the numbering wheels during a numbering operation.
Figure 8B:
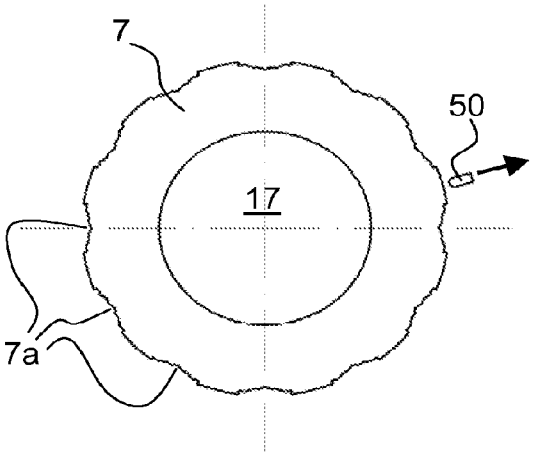
Figure 8C:
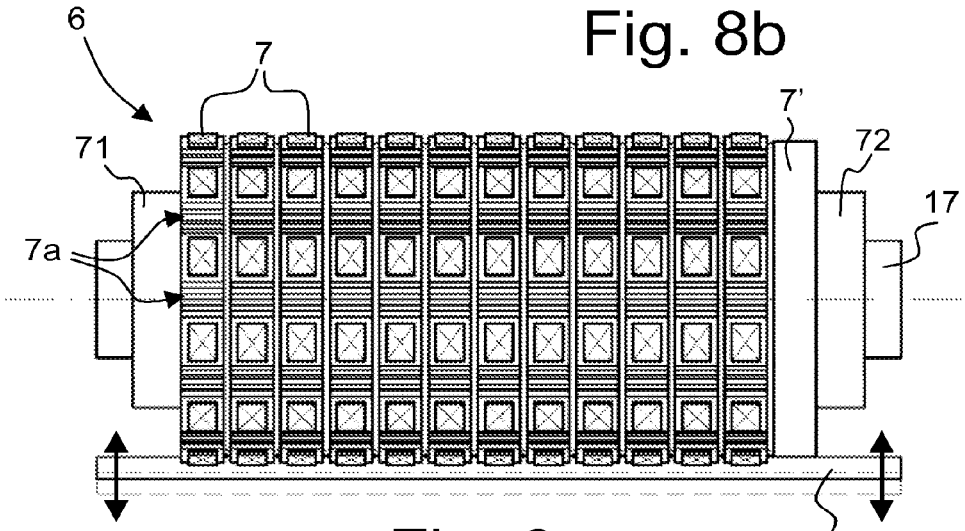

In the variant of FIGS. 8*a*-8*c*, the indexing mechanism might be provided at the location of one of the supporting members 14, 14' holding the calibration detectors 13 (this implying that all the said calibration detectors are disposed on one supporting member rather than two). As shown in FIGS. 8*a* and 8*c*, once all the numbering wheels 7 have been rotated to their target positions, the indexing member 50 is pushed forward against the outer indexing grooves 7*a*. Once the number has been printed, the indexing member 50 is brought backwards out of the outer indexing grooves 7*a* so as to allow rotation of the numbering wheels 7 to their subsequent target positions.

Figure 9A:
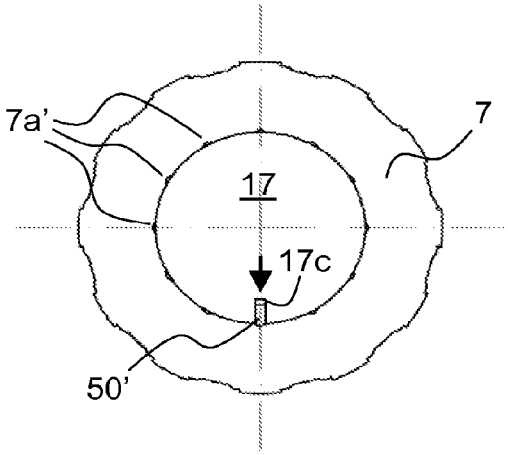
FIGS. 9*a*, 9*b* and 9*c* are views illustrating a second variant of a releasable indexing mechanism for mechanically aligning and maintaining the position of the numbering wheels during a numbering operation.
Figure 9B:
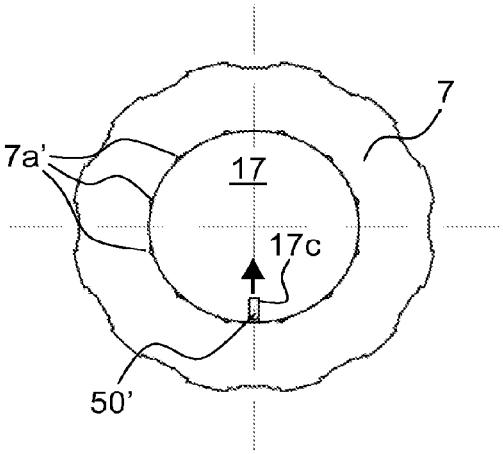
Figure 9C:
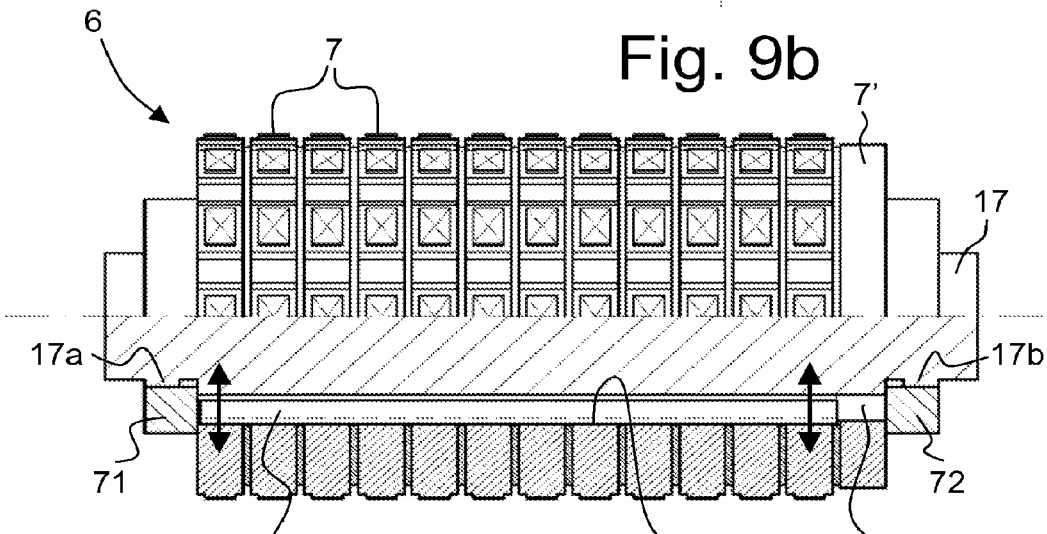

The operating principle is basically the same for the second variant as illustrated in FIGS. 9*a*-9*c*. In this latter case, the indexing member 50' can be disposed in a groove 17*c* extending axially along the periphery of the common shaft 17, which groove 17*c* further acts as a guide for the indexing member 50'. It will be appreciated that the required displacement for the indexing member 50' to be pushed against and pulled back out of the inner indexing grooves 7*a'* is less than in the first variant as the indexing member 50 of the first variant must be pulled back by an amount such that it does not lie in the path of the numbering symbols provided on the outer circumference of the numbering wheels.

Actuators (not shown) can be used to displace the indexing members 50, 50'. Such actuators are known as such in the art and do not need to be described again. In addition, it is advantageous to provide control means to check that the indexing member 50, 50' has been properly pushed into the indexing grooves 7*a*, 7*a'*. This can be detected by providing a pair of detectors at both ends of the indexing member 50, 50' to check the position of each extremity of the indexing member 50, 50'.

Figure 14A:
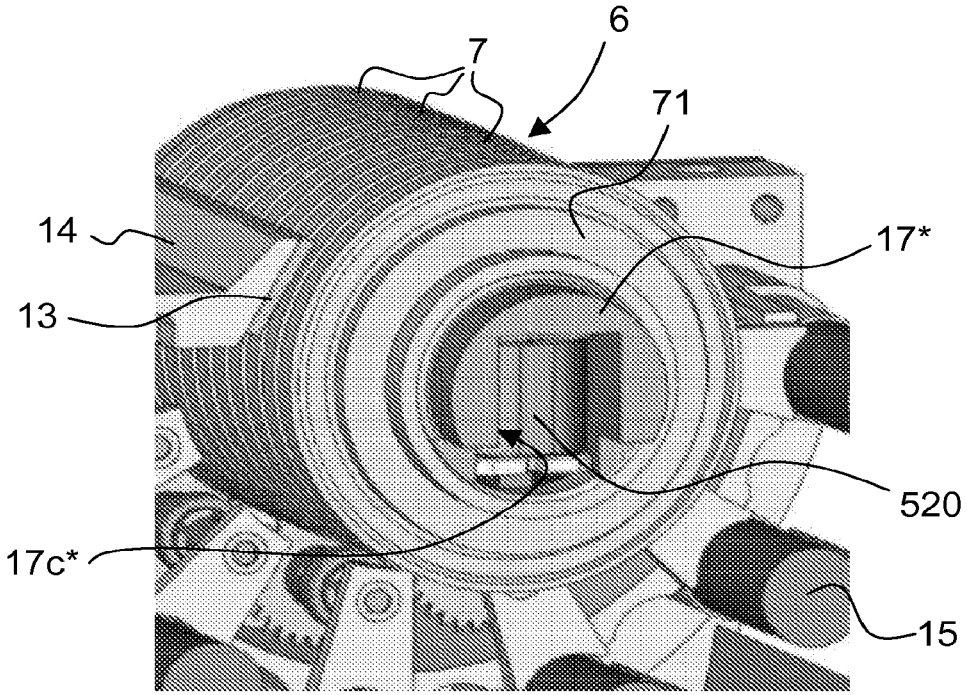
FIGS. 14*a* to 14*e* are partial perspective views illustrating an embodiment a releasable indexing mechanism pursuant to the first variant illustrated in FIGS. 8*a* to 8*c;*
Figure 14B:
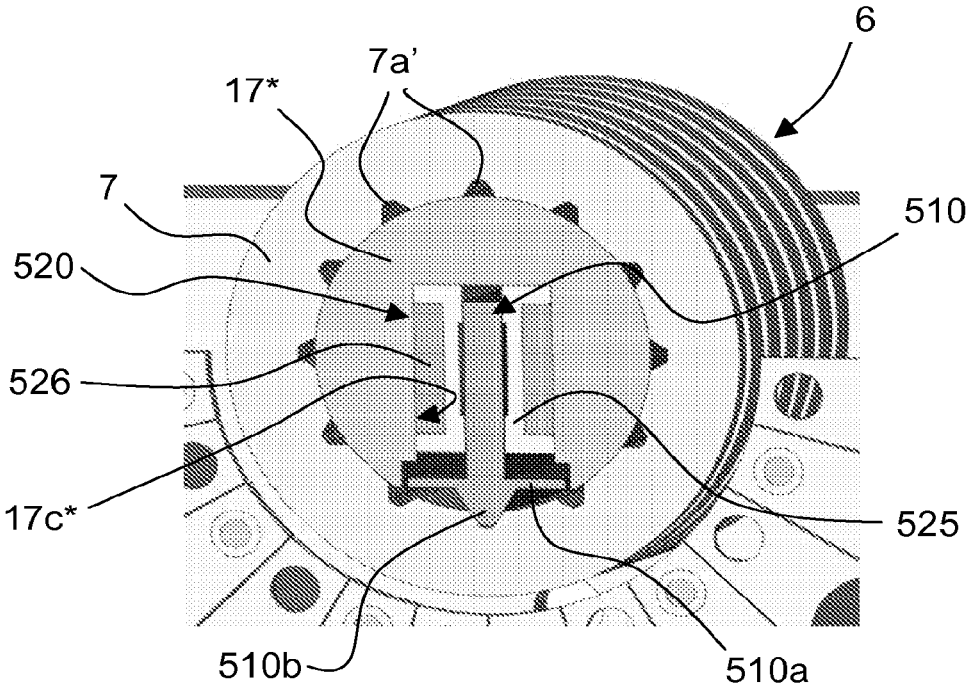
Figure 14C:
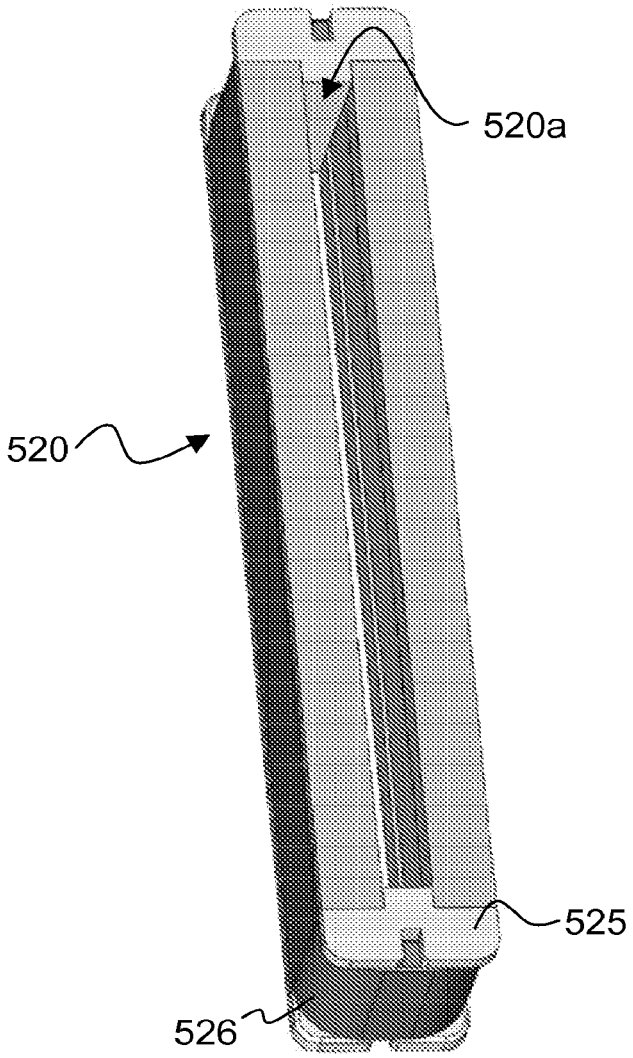
Figure 14D:
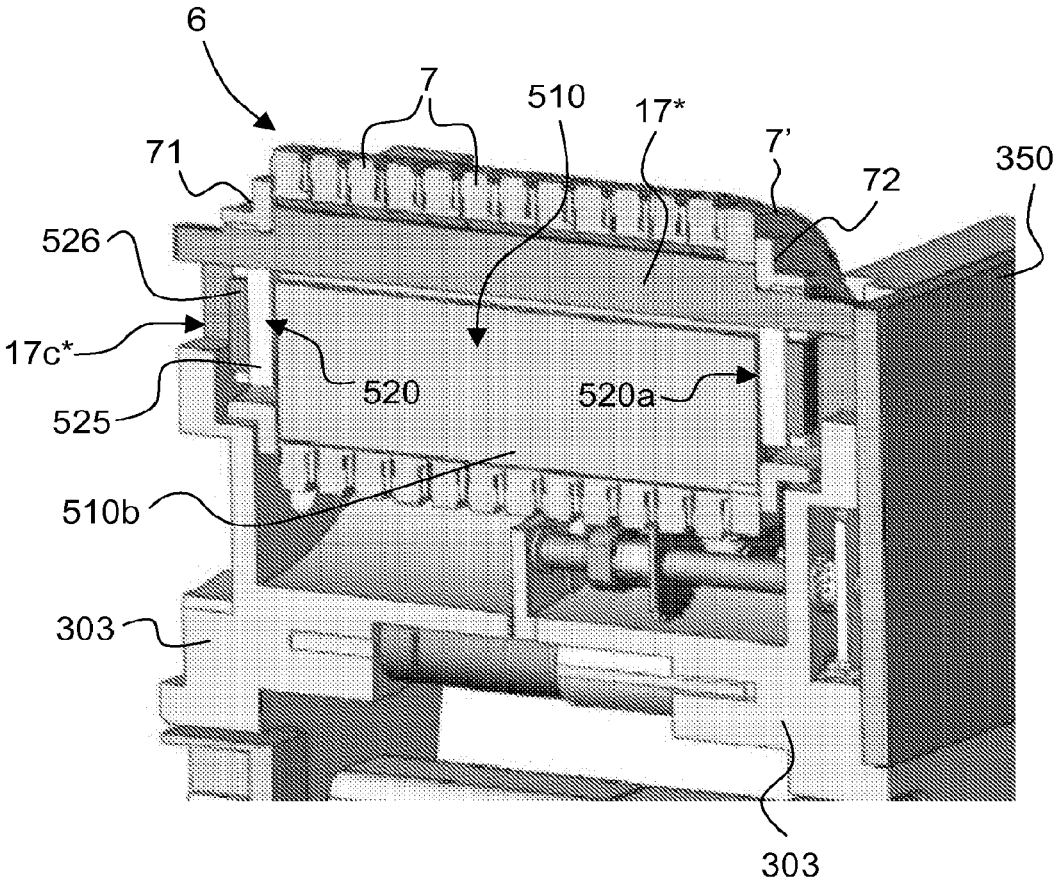
Figure 14E:
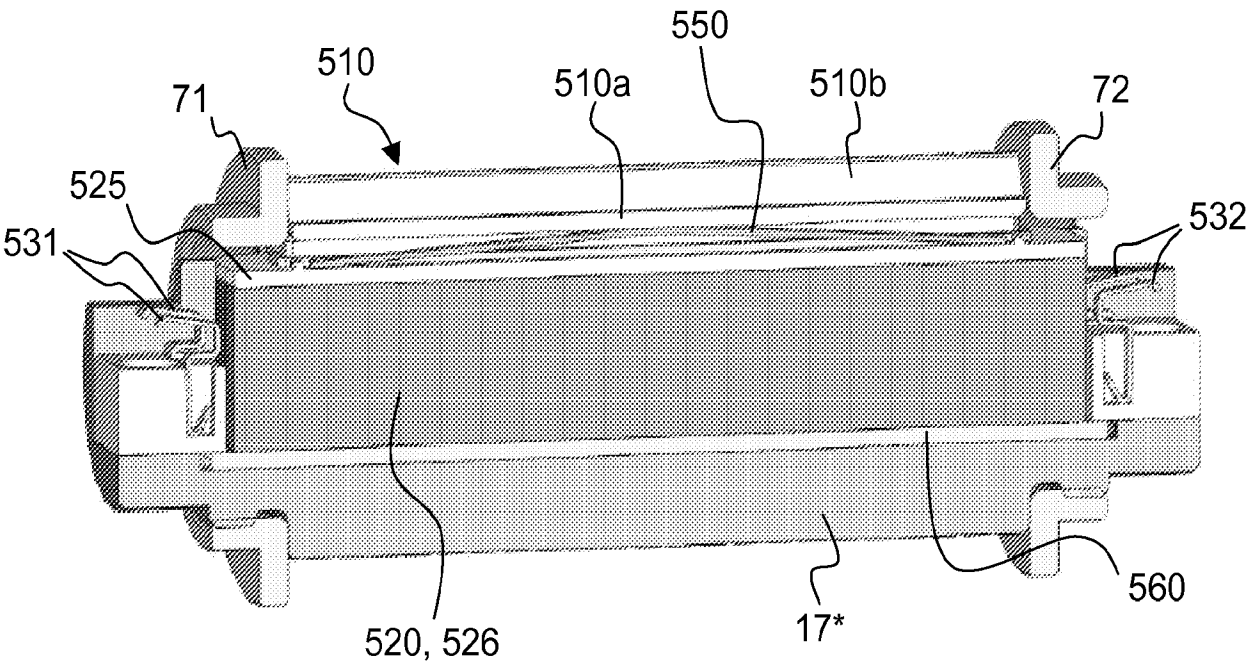

FIGS. 14*a* to 14*e* illustrate a possible embodiment of a releasable indexing mechanism which follows the principle described hereinabove in reference to FIGS. 9*a* to 9*c*. As illustrated in FIG. 14*b*, the indexing mechanism comprises in this example an indexing member 510 which is disposed, together with a coil 520, in an opening provided in the common shaft of the numbering wheels 7 (which shaft and opening are respectively designated by reference numerals 17* and 17*c in this example). As illustrated in FIG. 14***b*, the indexing member 510 has a substantially inverted-T-shaped cross-section with a head part 510*a* and a longitudinal extension 510*b* destined to cooperate with the inner indexing grooves 7*a*' of the numbering wheels 7, a vertical part (not referenced) of the indexing member 510 being located in an opening 520*a* of the coil 520. The indexing member 510 is allowed to move vertically within the common shaft 17* so as to selectively cooperate with inner indexing grooves 7*a*' of the numbering wheels 7 as explained before. Vertical displacement of the indexing member 510 is controlled via an electromagnetic energizing coil 520 which is also integrated within the common shaft 17*. This electromagnetic energizing coil 520, shown in isolation in FIG. 15*c*, is basically formed of a frame 525 defining an opening 520*a* for passage of a corresponding part of the indexing member 510, which frame 525 is surrounded by an electrically-conductive winding 526. As illustrated in FIG. 14*e*, electrical contacts 531, 532 connected to corresponding terminals (not shown) of the winding 526 are located at each end of the shaft 17*. These electrical contacts 531, 532 are intended to electrically connect the winding 526 to the corresponding control electronics of the numbering device. FIGS. 16*a* and 16*b*, which will be discussed hereinafter, illustrate a possible connection with the electrical contacts 531 or 532. When assembled, the electrical contacts 531 or 532 are oriented downwards towards electrical tracks provided on a flexible PCB element 126* provided on one side of the numbering device.

Preferably, as illustrated in FIG. 14*e*, a thin liner 560 made of non-magnetic material is placed inside the opening 17*c of the shaft 17*. This liner 560 acts as a shield preventing a magnetic and electrical short-circuit of the coil winding 526. The liner 560 also ensures that a gap remains between the moving indexing member 510 and the shaft 17*, thereby avoiding that the indexing member 510 gets stuck against the shaft 17***.

As illustrated in FIGS. 14*a* to 14*e*, the indexing member 510 and the electromagnetic energizing coil 520 are designed in such a manner that the coil 520 surrounds the indexing member 510. The indexing member 510 can be made of any material suitable for interaction with an electromagnetic actuation field. Electromagnetic actuation is a principle as such known in the art and does not need to be explained here. It suffices to understand that, under the action of an appropriate electromagnetic field generated by the electromagnetic energizing coil 520, the indexing member 510 is caused to be selectively lowered for cooperation with the indexing grooves 7*a*' of the numbering wheels 7 or raised for releasing the numbering wheels 7 to enable rotation thereof.

Preferably, a coil current creating a variable reluctance force is supplied to the energizing winding 526 of the coil 520 to move up the indexing member 510 and thereby release the numbering wheels 7. The indexing member 510 is preferably brought to its default position (i.e. the position wherein the indexing member 50 is pushed into the indexing grooves 7*a*', as illustrated in FIG. 14*b*) by means of springs 550, such as leaf springs (which springs are visible in FIG. 14*e*) placed between the head part 510*a* of the indexing member 510 and the shaft 17*.

Preferably, the numbering wheels 7 are made of a non-magnetic material or are coated with a non-magnetic material.

Figure 15A:
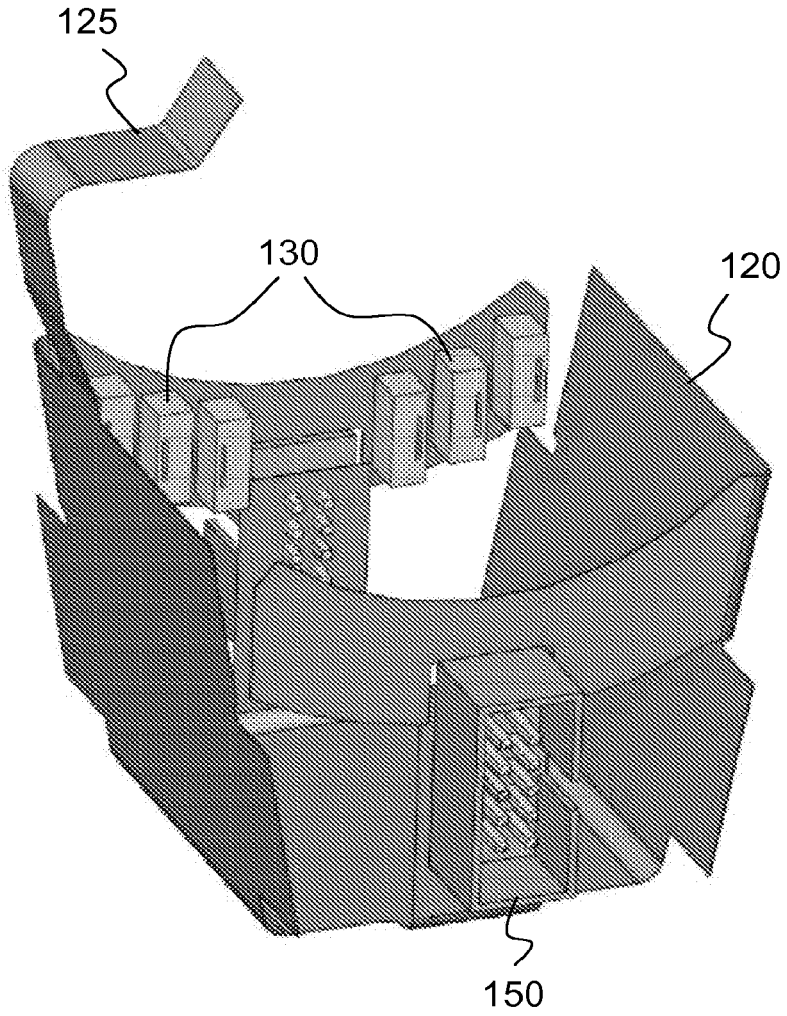
FIGS. 15*a* and 15*b* are views from two different perspectives of a flexible printed circuit board arrangement suitable for carrying the control electronics used for controlling operation of the numbering device.
Figure 15B:
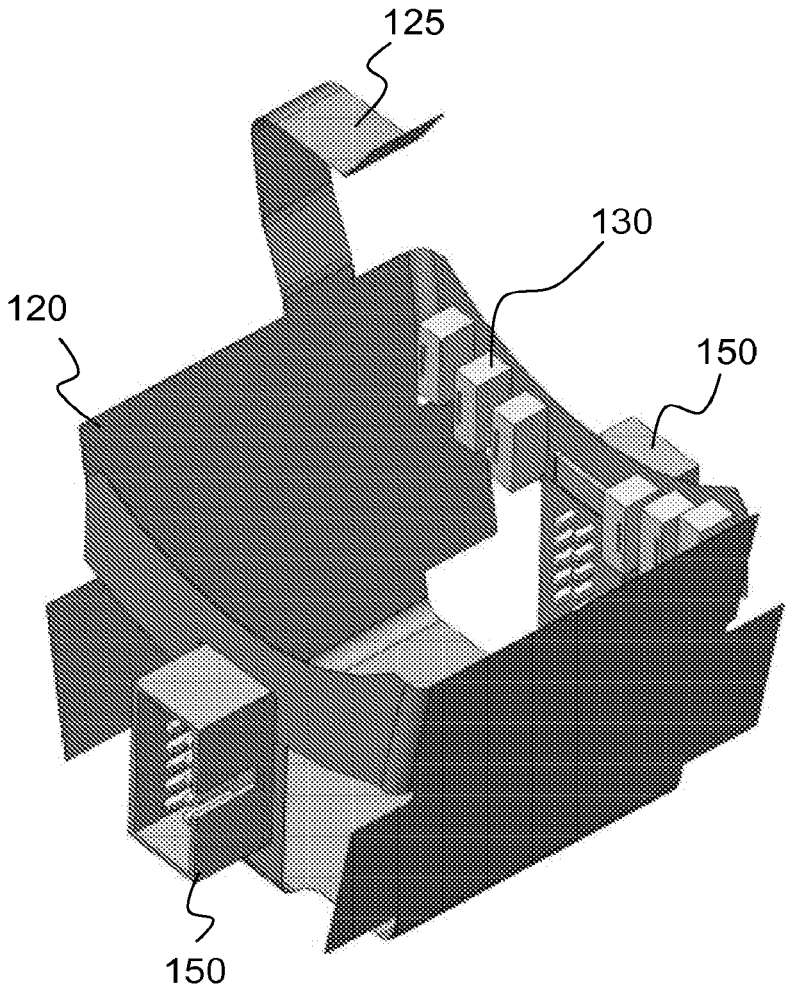
Figure 16A:
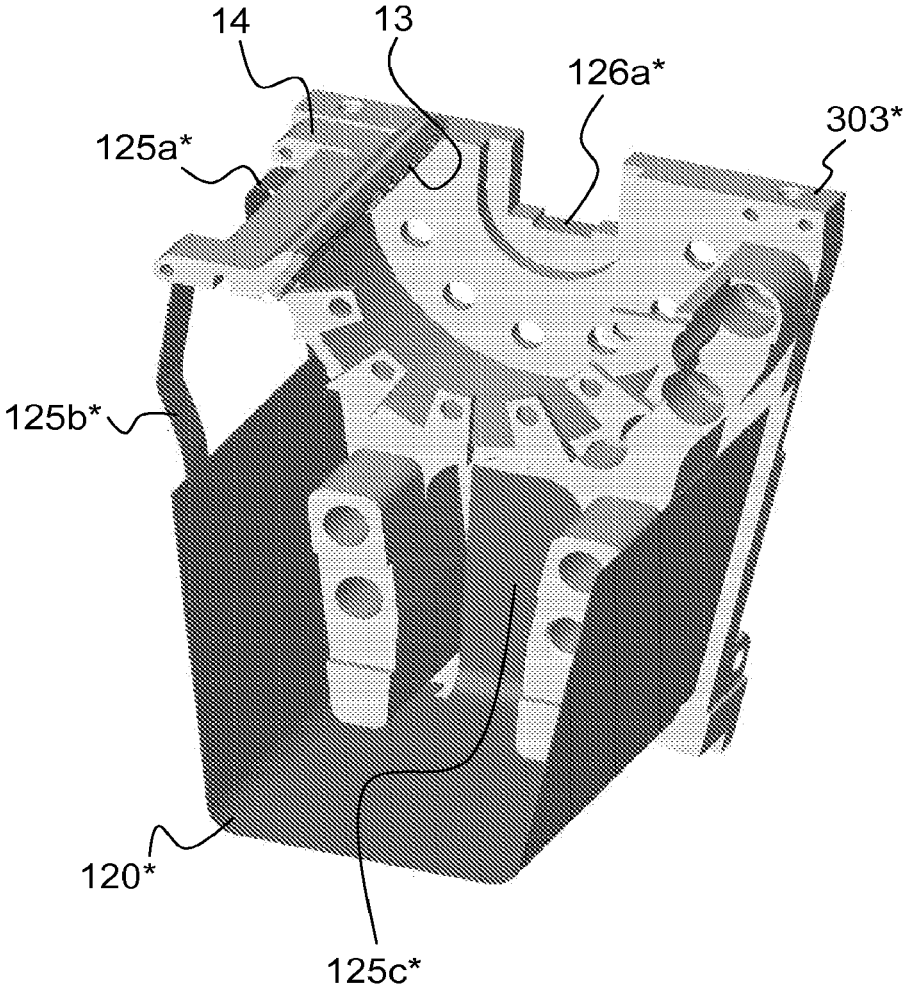
FIGS. 16*a* and 16*b* are views of another embodiment of a flexible printed circuit board arrangement suitable for carrying the control electronics used for controlling operation of the numbering device.
Figure 16B:
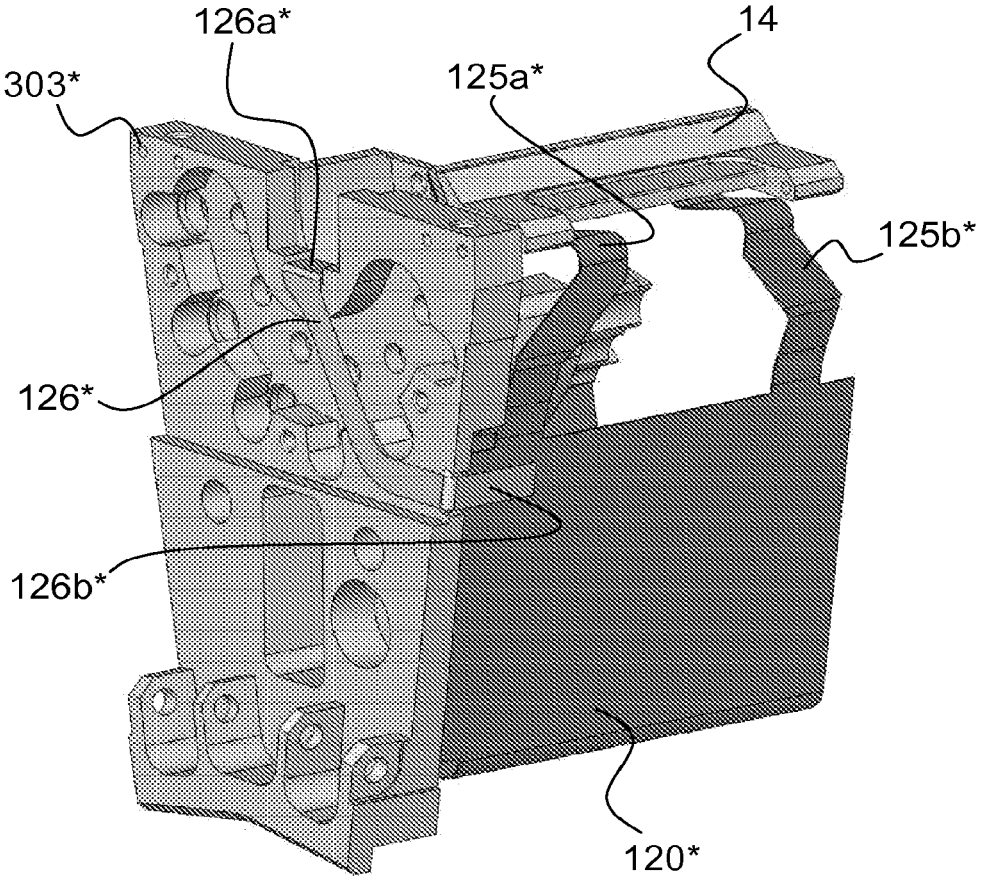

Let us now turn to FIGS. 15*a* and 15*b* which show an embodiment for disposing the control electronics of the numbering device within the casing thereof. According to this preferred embodiment, the control electronics is designed as a flexible printed circuit board (PCB) 120 with various supporting surfaces for locating the required electrical and electronic components (only parts thereof being illustrated in FIGS. 15*a* and 15*b*).

Thanks to its flexibility, the printed circuit board 120 can be folded to form a box-like configuration as shown in the Figures. On two opposite sides of this box-like configuration, one can see two multi-pole connectors 150 designed to be located, when mounted in the casing of the numbering device, in the corresponding openings thereof (i.e. openings 3*a*, 3*a*' in the embodiment of FIGS. 1 to 6 or opening 303*a* in the embodiment of FIGS. 10*a*, 10*b*, 11). As already mentioned, these two multi-pole connectors 150 enable connection of the electronics embedded in the numbering device to an external controller, especially the controller of a numbering press.

Six micro-controllers 130 are provided on each side of the box-like configuration of the flexible circuit board 120, i.e. twelve micro-controllers in total (only half of which being visible in FIGS. 15*a* and 15*b*), which micro-controllers 130 are designed to be coupled electrically by connectors (not shown) to the corresponding motors 15 of the driving means. The extension designated by reference numeral 125 in FIGS. 15*a* and 15*b* is designed for connection to the calibration sensors 13 provided on a corresponding supporting member 14, as described above (only one being envisaged in this embodiment). Such extension 125 is in particular intended to bear conductive tracks, not illustrated, for connection to the corresponding calibration sensors 13. A second extension might be provided on the flexible printed circuit board 120 for connection to another set of calibration sensors, should these be disposed on two separate supporting members 14, 14', as discussed above.

FIGS. 16*a* and 16*b* illustrate another embodiment for disposing the control electronics of the numbering device within the casing thereof. In FIGS. 16*a* and 16*b*, there is shown a frame part 303* of the casing of the numbering device that substantially corresponds to the frame part 303 discussed hereinabove in reference to FIGS. 10*a*, 10*b* and 11, together with one supporting member 14 carrying calibration sensors 13. A flexible PCB 120* similar to the flexible PCB 120 of FIGS. 15*a* and 15*b* is disposed in the frame part 303*.

In contrast to the embodiment illustrated in FIGS. 15*a* and 15*b*, the flexible PCB 120* comprises a single extension 125*c for connection to an electrical connector (not shown) placed in the lateral opening of the frame part 303* in the same way as discussed above. In addition, two extensions 125*a, 125*b are provided on one side of the flexible PCB 120* for connection to the corresponding detectors 13 provided on the supporting member 14**.

In additional an additional flexible PCB element designated by reference numeral 126* in FIG. 16*b* is provided for connection of the electronics located on the flexible PCB 120* to the electromagnetically-actuated indexing mechanism 510, 520 which was described above in reference to FIGS. 14*a* to 14*e*. More precisely, the flexible PCB element 126* is provided with conductive tracks for connection of the electrical connectors (531 or 532 in FIG. 14*e*) on the coil winding 526 to the control electronics provided on the flexible PCB 120*. One extremity 126*a (also visible in FIG. 16***a*) of the flexible PCB element 126* thus extends up to the opening on top of the frame part 303* where the corresponding end of the shaft 17* with the electrical connectors 351 (or 352) of the numbering unit 6 is to be located. The other end 126*b of the flexible PCB element 126* is coupled to the main flexible PCB 120*. The flexible PCB element 126* could alternatively be an integral part of the main flexible PCB 120***.

It will be understood that various modifications and/or improvements obvious to the person skilled in the art can be made to the embodiments described hereinabove without departing from the scope of the invention defined by the annexed claims. For instance, in the illustrated embodiment, all numbering wheels are driven by independent driving means. The invention is however also applicable to cases where only a part of said numbering wheels have to be actuated by independent driving means, the remaining part being manually-actuated numbering wheels. This is for instance possible when prefix wheels are used which do not need to be actuated too often. In this case, the prefix wheels can simply be actuated by hand by an operator each time the prefix is changed.

In addition, the preferred driving means for driving the numbering wheels into rotation comprise an electric motor driving the corresponding numbering wheel via a gearing. As any gearing exhibits a certain mechanical play, one should try to limit this play as much as possible. Means for compensating this play could be envisaged, in particular by providing means for compensating play between at least two cooperating gears of the gearings. This could for instance be achieved by designing at least some of the gears of the gearings so that they exhibit a certain elasticity for compensating radial and/or axial play.

As already mentioned hereinabove, numbering device with less than twelve independently-driven numbering wheels could be envisaged within the scope of the invention. If the number of independently-driven numbering wheels is less than twelve, one will appreciate that this will provide greater space for distributing the driving means about the rotation axis of the numbering wheels. As this is apparent from the drawings, the available space for locating the driving means covers an angular sector of approximately 180° around the rotation axis of the numbering wheels. In the illustrated embodiment, up to twelve independent driving means have been disposed with the available space by advantageously interlocking two halves of the driving means. Such interlocking might not be necessary for numbering device with less numbering wheels.

The invention claimed is:

1. A numbering device for carrying out numbering in sheet-fed or web-fed numbering presses, the numbering device comprising a casing and a numbering unit with rotatable numbering wheels carrying alpha-numerical symbols thereon, which numbering wheels are disposed next to each other and rotate about a common rotation axis, the numbering device further comprising electro-mechanical actuation means for setting the position of the numbering wheels, wherein the electro-mechanical actuation means are disposed in an inner space of the casing of the numbering device and are mechanically autonomous, the electro-mechanical actuation means comprising a plurality of independent driving means for actuating a corresponding plurality of the numbering wheels, wherein each independent driving means comprises an electric motor driving an associated numbering wheel through a gear-wheel assembly, which gear-wheel assembly exhibits a reduction factor, wherein each electric motor is a brush-less DC motor with electronic commutation, wherein each independent driving means exhibits an overall reduction factor between an output of the electric motor and the associated numbering wheel, wherein the numbering device comprises more than six rotatable numbering wheels actuated by a corresponding number of the independent driving means, wherein all of the numbering wheels are actuated by independent driving means, and wherein the gear-wheel assembly comprises a driving pinion mounted onto a shaft, which driving pinion meshes with a toothed wheel disposed on a side of the associated numbering wheel, and wherein the driving pinion is configured to be adjustable in an axial direction along the shaft.

2. The numbering device according to claim 1, further comprising calibration sensors for calibrating the position of the numbering wheels actuated by the electro-mechanical actuation means, each calibration sensor cooperating with at least one magnet carried by the numbering wheel to be calibrated.

3. The numbering device according to claim 2, wherein the calibration sensors are Hall-effect detectors.

4. The numbering device according to claim 1, wherein each electric motor is coupled to the gear-wheel assembly via a reduction gear, which reduction gear exhibits an additional reduction factor and provides an additional reduction of the output speed and an additional increase of the output torque of the electric motor.

5. The numbering device according to claim 4, wherein the reduction gear is a miniature planetary gear.

6. The numbering device according to claim 4, wherein the reduction gear and associated electric motor are coaxial.

7. The numbering device according to claim 1, wherein the driving pinion is equipped with a releasable clamping ring for adjustment of the axial position of the driving pinion along the shaft.

8. The numbering device according to claim 7, wherein the driving pinion comprises a tubular portion forming an integral part with a pinion wheel portion, which tubular portion is provided at an extremity with longitudinal slits enabling deformation of the extremity of the tubular portion under the action of the releasable clamping ring.

9. The numbering device according to claim 1, wherein the overall reduction factor between the output of the electric motor and the corresponding numbering wheel is selected to be such that an angular resolution of the numbering wheel is of less than 1°.

10. The numbering device according to claim 1, wherein the overall reduction factor between the output of the electric motor and the corresponding numbering wheel is about one hundred.

11. The numbering device according to claim 1, comprising twelve rotatable numbering wheels actuated by a corresponding number of the independent driving means.

12. The numbering device according to claim 1, wherein the independent driving means are distributed within an angular sector about the rotation axis of the numbering wheels and are located at equal distance to the rotation axis of the numbering wheels.

13. The numbering device according to claim 1, wherein first and second parts of the independent driving means are disposed head-to-tail about the rotation axis of the numbering wheels.

14. The numbering device according to claim 1, further comprising a releasable indexing mechanism for mechanically aligning and maintaining the position of the numbering wheels during a numbering operation.

15. A numbering device for carrying out numbering in sheet-fed or web-fed numbering presses, the numbering device comprising a casing and a numbering unit with rotatable numbering wheels carrying alpha-numerical symbols thereon, which numbering wheels are disposed next to each other and rotate about a common rotation axis, the numbering device further comprising electro-mechanical actuation means for setting the position of the numbering wheels, wherein the electro-mechanical actuation means are disposed in an inner space of the casing of the numbering device and are mechanically autonomous, the electro-mechanical actuation means comprising a plurality of independent driving means for actuating a corresponding plurality of the numbering wheels, wherein each independent driving means comprises an electric motor driving an associated numbering wheel through a gear-wheel assembly, which gear-wheel assembly exhibits a reduction factor, wherein each electric motor is a brush-less DC motor with electronic commutation, wherein each independent driving means exhibits an overall reduction factor between an output of the electric motor and the associated numbering wheel, wherein the numbering device comprises more than six rotatable numbering wheels actuated by a corresponding number of the independent driving means, wherein a part of the numbering wheels are actuated by independent driving means and a remaining part of the numbering wheels are manually-actuated numbering wheels, and wherein the gear-wheel assembly comprises a driving pinion mounted onto a shaft, which driving pinion meshes with a toothed wheel disposed on a side of the associated numbering wheel, and wherein the driving pinion is configured to be adjustable in an axial direction along the shaft.

16. The numbering device according to claim 15, further comprising calibration sensors for calibrating the position of the numbering wheels actuated by the electro-mechanical actuation means, each calibration sensor cooperating with at least one magnet carried by the numbering wheel to be calibrated.

17. The numbering device according to claim 16, wherein the calibration sensors are Hall-effect detectors.

18. The numbering device according to claim 15, wherein each electric motor is coupled to the gear-wheel assembly via a reduction gear, which reduction gear exhibits an additional reduction factor and provides an additional reduction of the output speed and an additional increase of the output torque of the electric motor.

19. The numbering device according to claim 18, wherein the reduction gear is a miniature planetary gear.

20. The numbering device according to claim 18, wherein the reduction gear and associated electric motor are coaxial.

21. The numbering device according to claim 15, wherein the driving pinion is equipped with a releasable clamping ring for adjustment of the axial position of the driving pinion along the shaft.

22. The numbering device according to claim 21, wherein the driving pinion comprises a tubular portion forming an integral part with a pinion wheel portion, which tubular portion is provided at an extremity with longitudinal slits enabling deformation of the extremity of the tubular portion under the action of the releasable clamping ring.

23. The numbering device according to claim 15, wherein the overall reduction factor between the output of the electric motor and the corresponding numbering wheel is selected to be such that an angular resolution of the numbering wheel is of less than 1°.

24. The numbering device according to claim 15, wherein the overall reduction factor between the output of the electric motor and the corresponding numbering wheel is about one hundred.

25. The numbering device according to claim 15, wherein the independent driving means are distributed within an angular sector about the rotation axis of the numbering wheels and are located at equal distance to the rotation axis of the numbering wheels.

26. The numbering device according to claim 15, wherein first and second parts of the independent driving means are disposed head-to-tail about the rotation axis of the numbering wheels.

27. The numbering device according to claim 15, further comprising a releasable indexing mechanism for mechanically aligning and maintaining the position of the numbering wheels during a numbering operation.

* * * * *